US005614688A

United States Patent [19]

Donnell

[11] Patent Number: 5,614,688

[45] Date of Patent: Mar. 25, 1997

[54] TRANSDUCER SYSTEM FOR ACOUSTIC INSTRUMENTS

[76] Inventor: Kenneth D. Donnell, 24 Parkhurst St., Chico, Calif. 95928

[21] Appl. No.: 347,949

[22] Filed: Dec. 1, 1994

[51] Int. Cl.[6] ..... G10H 1/32; G10H 3/00

[52] U.S. Cl. ..... 84/743

[58] Field of Search ..... 84/723, 743

[56] References Cited

U.S. PATENT DOCUMENTS

| | | | |
|---|---|---|---|
| 4,227,434 | 10/1980 | DiMarzio . | |
| 4,394,830 | 7/1983 | Damiano . | |
| 4,404,885 | 9/1983 | Salak . | |
| 4,425,831 | 1/1984 | Lipman | 84/743 |
| 4,433,603 | 2/1984 | Siminoff | 84/743 |
| 4,501,186 | 2/1985 | Ikuma . | |
| 4,748,886 | 6/1988 | De Byl . | |
| 4,854,210 | 8/1989 | Palazzolo . | |
| 4,872,386 | 10/1989 | Betticare | 84/726 |
| 5,010,803 | 4/1991 | Donnell . | |
| 5,012,716 | 5/1991 | Pagelli | 84/743 |
| 5,029,511 | 7/1991 | Rosendahl . | |
| 5,252,777 | 10/1993 | Allen | 84/743 |
| 5,401,900 | 3/1995 | Lace | 84/743 |

*Primary Examiner*—William M. Shoop, Jr.
*Assistant Examiner*—Jeffrey W. Donels
*Attorney, Agent, or Firm*—Kilpatrick & Cody, L.L.P.; John S. Pratt

[57] ABSTRACT

A transducer system for an acoustic instrument such as a guitar or violin including a receptacle for mounting on the instrument coupled electronically to an output jack for mounting in a remote location on the instrument and a transducer or pickup assembly that plugs into the receptacle.

17 Claims, 33 Drawing Sheets

TRANSDUCER SYSTEM FOR ACOUSTIC INSTRUMENTS

BACKGROUND OF THE INVENTION

Acoustic stringed musicians have long sought a mechanism for mounting transducers onto their instruments which will not attach directly to the soundboard of the instrument, will not disturb the playing motions of the instrumentalist, offers the capacity for quick and easy interchange of different transducers without having to de-tune or remove the strings, and offers the option of removing the transducer from the instrument when not needed.

Many designs exist for mounting transducers on acoustic stringed musical instruments. These designs involve the use of screws, spring clips, flexible shafts, telescoping arms, clamps, adjustable rails, foam pads, mounting frames, and similar methods.

There are three common elements to be found in most of these mounting mechanisms, and each mechanism includes one or all of these three elements:

First, there is no effective means for interchanging different transducers. One transducer is permanently mounted onto each mechanism.

Second, some part of the transducer assembly or mounting mechanism is affixed to the surface of the instrument (often the soundhole of the instrument) in a manner that is aesthetically unpleasing, may cause damage via friction to the parts of the instrument where the device is affixed, may disturb the playing motions of the instrumentalist, and/or may dampen the vibrating abilities of the instrument to produce acoustical sound.

Third, there is an output cable which emerges from the transducer and is left to lay against the face (soundboard) of the instrument. This leaves the cable in a position which may hinder the playing motions of the instrumentalist, and also poses a danger to the instrument. If the cable is accidentally pulled or tensioned, it may tear the transducer away from the instrument, and thereby damage the parts of the instrument to which the device is affixed. An alternative is to permanently connect the output cable from the transducer to an output jack located elsewhere on the instrument. This solves the above mentioned problems related to the cable, but the transducer will then be permanently installed in the soundhole of the instrument.

The prior art which does offer the possibility of interchanging transducers is limited to use on solid body electric guitars using only electromagnetic pickups, and is not applicable to acoustic guitars or other acoustic musical instruments. These designs for electric guitars always use the plugs/pins attached to the transducer only for the normal purpose of conducting electronic signals. Mounting frames and/or screws are used to accomplish the task of physically mounting the pickup onto the instrument.

Exemplary prior art includes U.S. Pat. Nos. 4,501,186, 4,227,434, 4,394,830, 4,404,885, 5,010,803, 4,854,210, 5,029,511, 4,748,886, and 5,010,803.

SUMMARY OF THE INVENTION

This invention comprises two components:

The first component is a receptacle which is mounted onto the instrument. This receptacle embodies sleeves or other female audio connectors (jacks) which are electronically connected to an output jack located elsewhere on the instrument.

The second component is a series of transducer assemblies which have male audio connectors (plugs) mounted directly onto the casing of the device. These plugs are electronically connected to the output conductors of the transducer and are positioned to be received by the female connectors (sleeves) of the receptacle.

When the plugs on the transducer assembly are mated with the sleeves on the receptacle, the transducer assembly is physically mounted beneath the strings of the instrument, and the transducer(s) located within the casing is(are) simultaneously coupled via the plugs and sleeves to the output jack for communication with other electronic devices outside the instrument.

The receptacle is mounted onto the instrument in a manner such that there is little or no effect upon the vibrating qualities of the instrument and there is no part of the receptacle or transducer assembly positioned in a manner which will disturb the playing motions of the instrumentalist.

Should the player so desire, the transducer assembly may be temporarily, or permanently removed from the instrument. Once the transducer assembly is removed, there will be no parts of the mechanisms related to the device or the receptacle readily visible from outside the instrument.

The preferred design of the receptacle embodies three large and two small sleeves, for a total of five sleeves. The three large sleeves are dedicated to output functions, and the two small sleeves are designated for input functions to receive the signals from an independent electronic device.

The transducer assembly may embody only the three large plugs to serve as output conductors for the transducer(s) enclosed within the casing of the transducer assembly. Or the transducer assembly may embody five plugs, three large and two small. The signals of an independent electronic device may be received by the two small plugs when the transducer assembly of this invention is engaged to a receptacle where the two small sleeves are electronically connected to the independent electronic device.

These signals from the independent electronic device can be routed through the casing of the transducer assembly before being finally connected to the output jack via a multi-conductor cable. This independent electronic device may function independently of, or in combination with, any of the transducer assemblies described herein. It is also possible that electronic components may be enclosed within the casing of the transducer assembly which will service the independent electronic device.

The number and pattern of the sleeves and plugs shown in the figures are created in a manner that permits a variety of transducer assemblies to be easily and quickly mounted or dismounted according to the wishes of the instrumentalist. There is no need to remove the strings of the instrument when installing or removing the transducer assemblies. Friction between the plugs (on the transducer assembly) and the sleeves (within the receptacle) hold the transducer assembly securely onto the instrument through all normal usage.

DESCRIPTION OF THE PREFERRED EMBODIMENTS OF THE INVENTION

Figure 1:
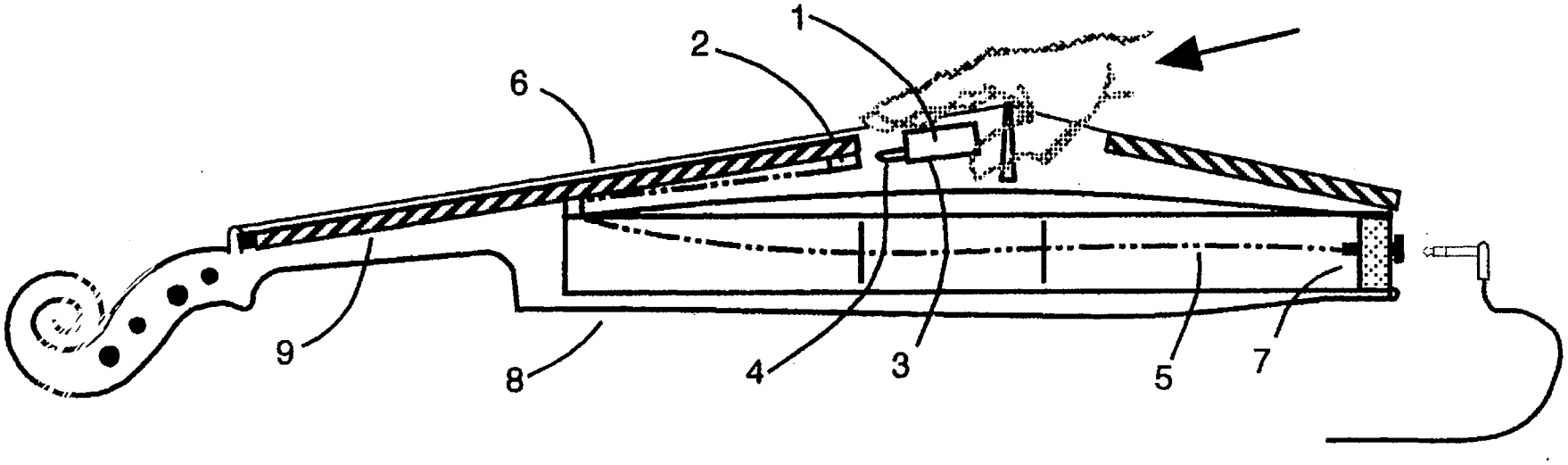
FIG. 1 is the side view of a violin with a receptacle installed underneath the fingerboard which is electronically connected to an output jack, and a transducer assembly which embodies output plugs designed to be received by the receptacle.

The present invention is a two-part system. The first part is a receptacle 2 which is designed to be mounted onto a violin 8, guitar 14, or similar acoustic musical instrument. The receptacle 2 embodies jacks, sleeves, or other female electronic components 12 and 19 which are electronically connected via a multi-conductor cable 5 to an output jack 7 located elsewhere on the instrument.

The second part of the invention is a transducer assembly 1 which embodies a transducer(s) whose output conductors 18 are connected to plugs 4 and 20 or other male electronic components attached to the casing 3 of the transducer assembly 1 in a manner whereby the plugs 4 and 20 may be received by the jacks, sleeves, or other female electronic components 12 and 19 of the receptacle 2.

When the plugs 4 and 20 on the transducer assembly 1 are mated with the sleeves 12 and 19 of the receptacle 2, the transducer assembly 1 will simultaneously be mounted beneath the strings 6 of the violin 8 or guitar 14, and electronically connected to the output jack 7 located elsewhere on the instrument. The transducer within the transducer assembly 1 may then be employed for the purpose of amplifying, recording, tuning, or otherwise electronically manipulating the acoustic sound of the instrument.

While the figures show the use of specific types of transducers, it is possible that any type of transducer, components, or electronic mechanism which is small enough to fit inside the soundhole 10 of an acoustic guitar 14, or near the fingerboard of a violin 8 or similar acoustic musical instrument, could be mounted singly or jointly within the casing of the transducer assembly 1. FIGS. 3–7 show transducer assemblies which embody electromagnetic pickups within the casing 3.

There is sufficient friction between the plugs 4 and 20 and the sleeves 12 and 19 for the transducer assembly 1 to remain securely attached to the receptacle 2 during all normal playing motions. It is possible to employ a receptacle which embodies only the three large sleeves 12, but its use will be limited to three conductors.

Figure 2:
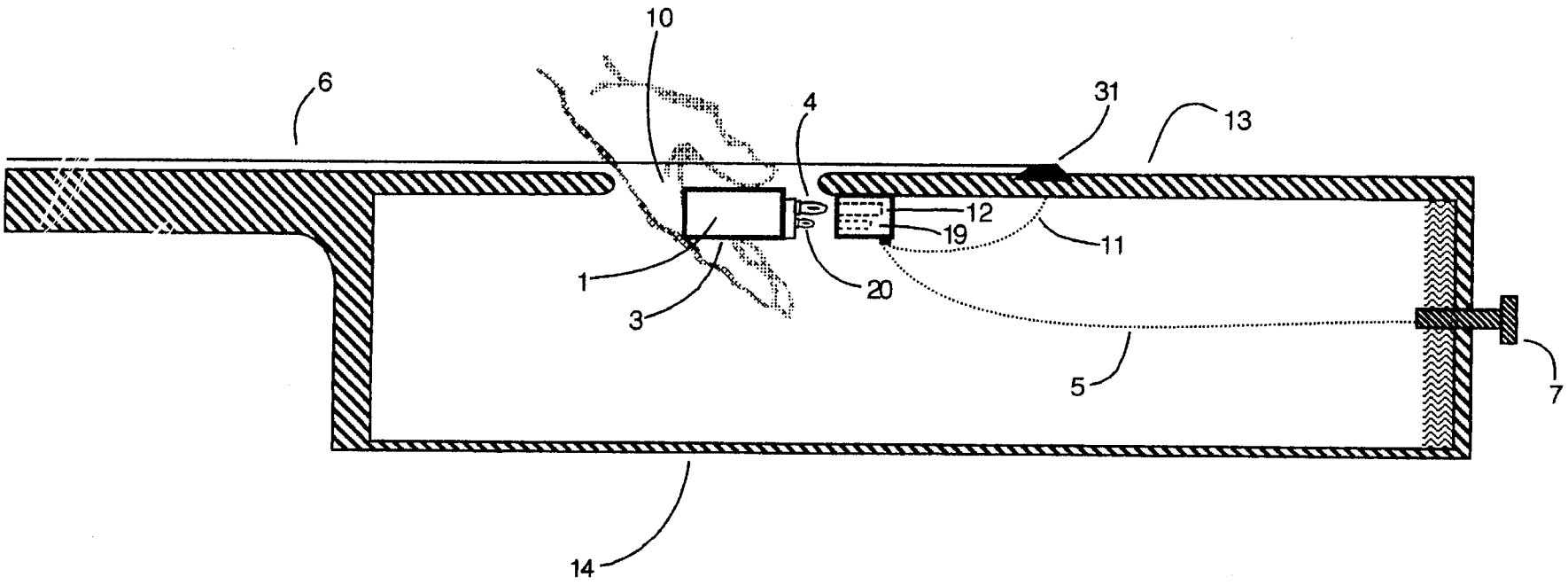
FIG. 2 is the cut-away side view of a guitar with a receptacle mounted underneath the soundboard and electronically connected to both an output jack and an independent electronic device, with a transducer assembly of this invention which embodies output and input plugs designed to be received by the receptacle.
Figure 33:
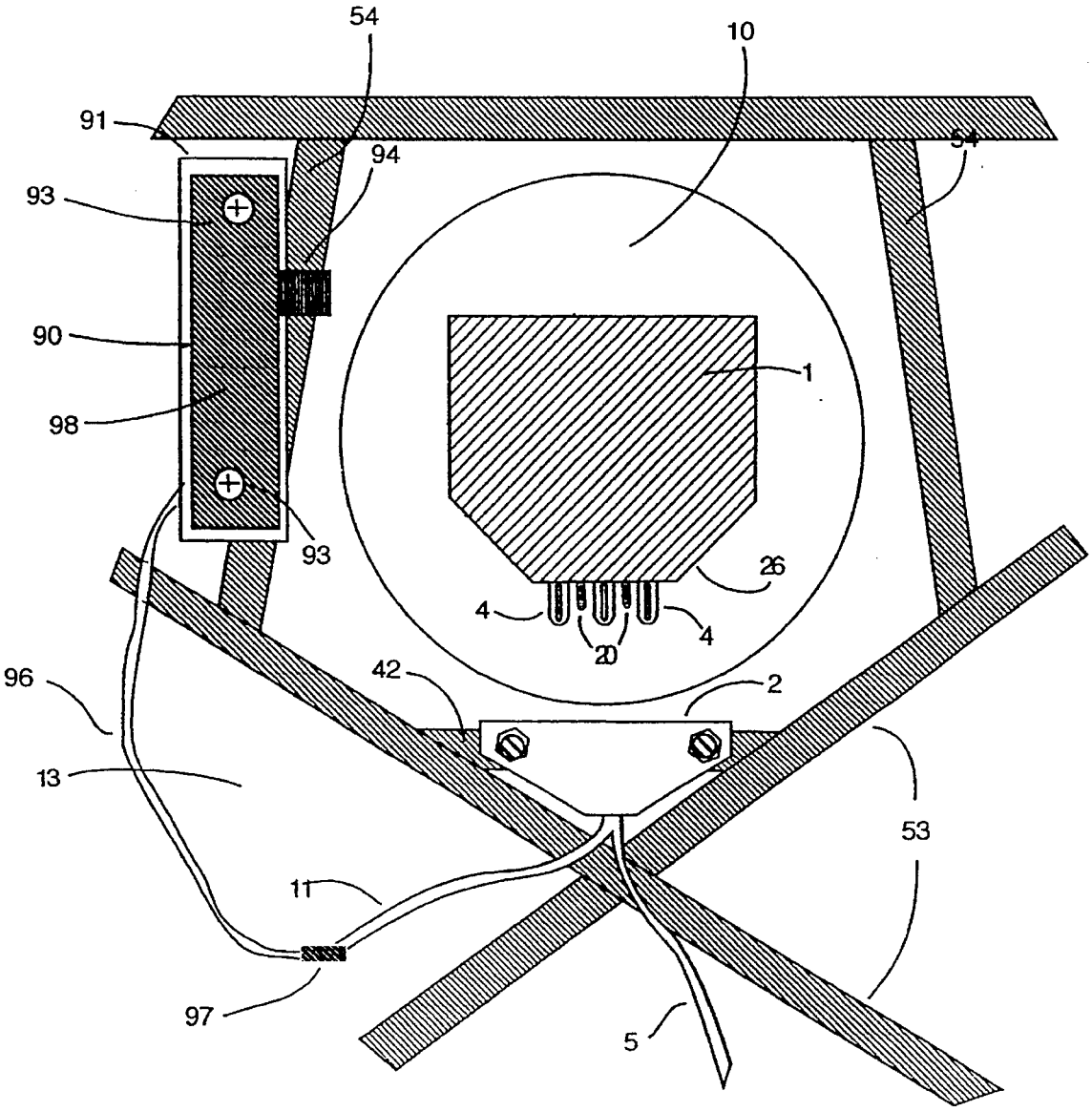
FIG. 33 shows the view from inside an acoustic guitar where the independent electronic device of FIG. 32 is mounted to the underside of the guitar's soundboard and electronically connected to the receptacle.

The receptacle 2 is designed to have three output sleeves 12, and two input sleeves 19. The output sleeves 12 will be electronically connected to the output jack 7. The input sleeves 19 may be electronically connected to an independent electronic device 31 and 90 located elsewhere in the instrument as shown in FIGS. 2 and 33 via a coaxial cable 11.

Figure 3:
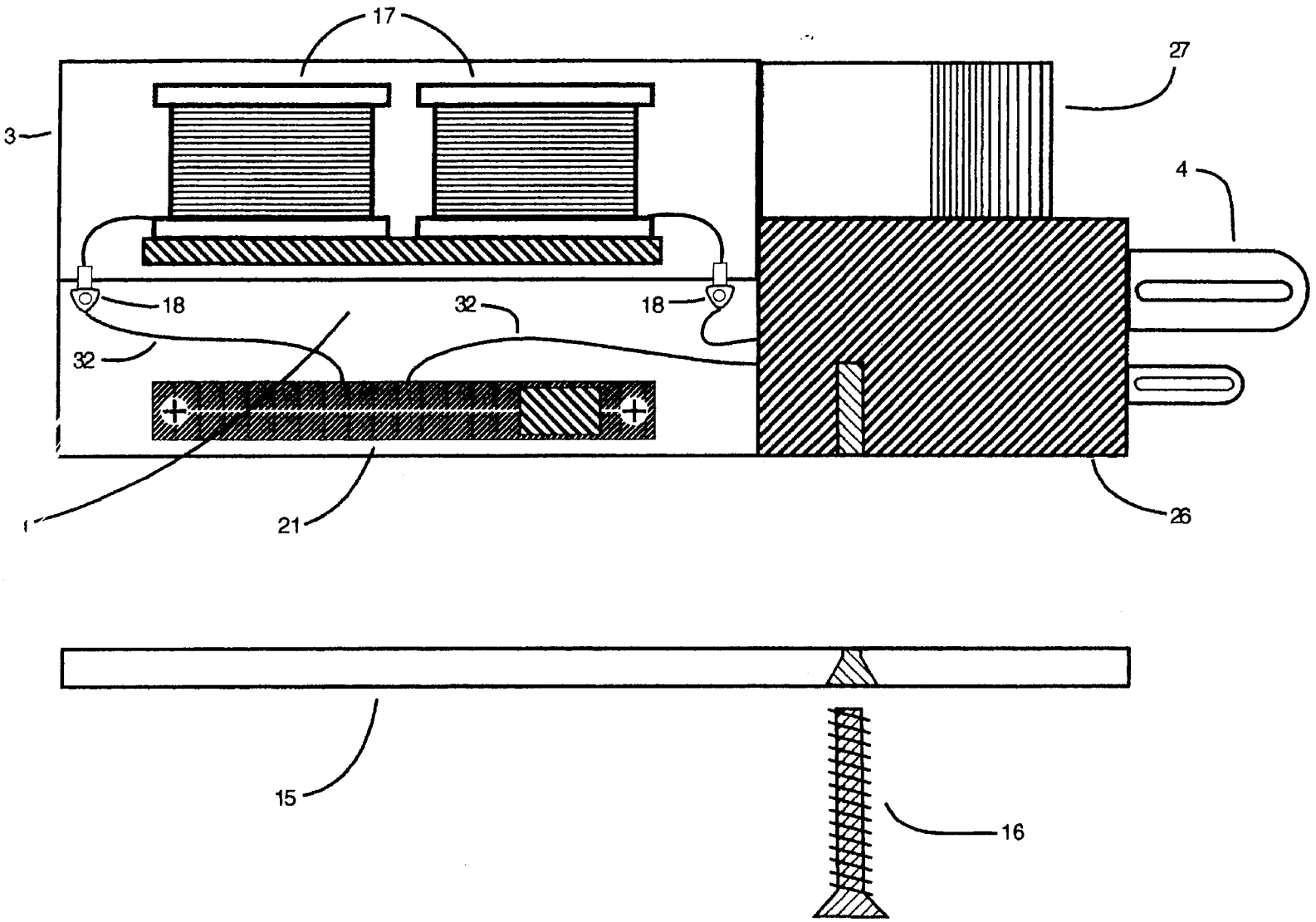
FIG. 3 is the cut-away side view of a transducer assembly which embodies a transducer in the form of an electromagnetic pickup, and a slide potentiometer to service the transducer, both of which are electronically connected to banana plugs mounted onto the casing of the transducer assembly.
Figure 6:
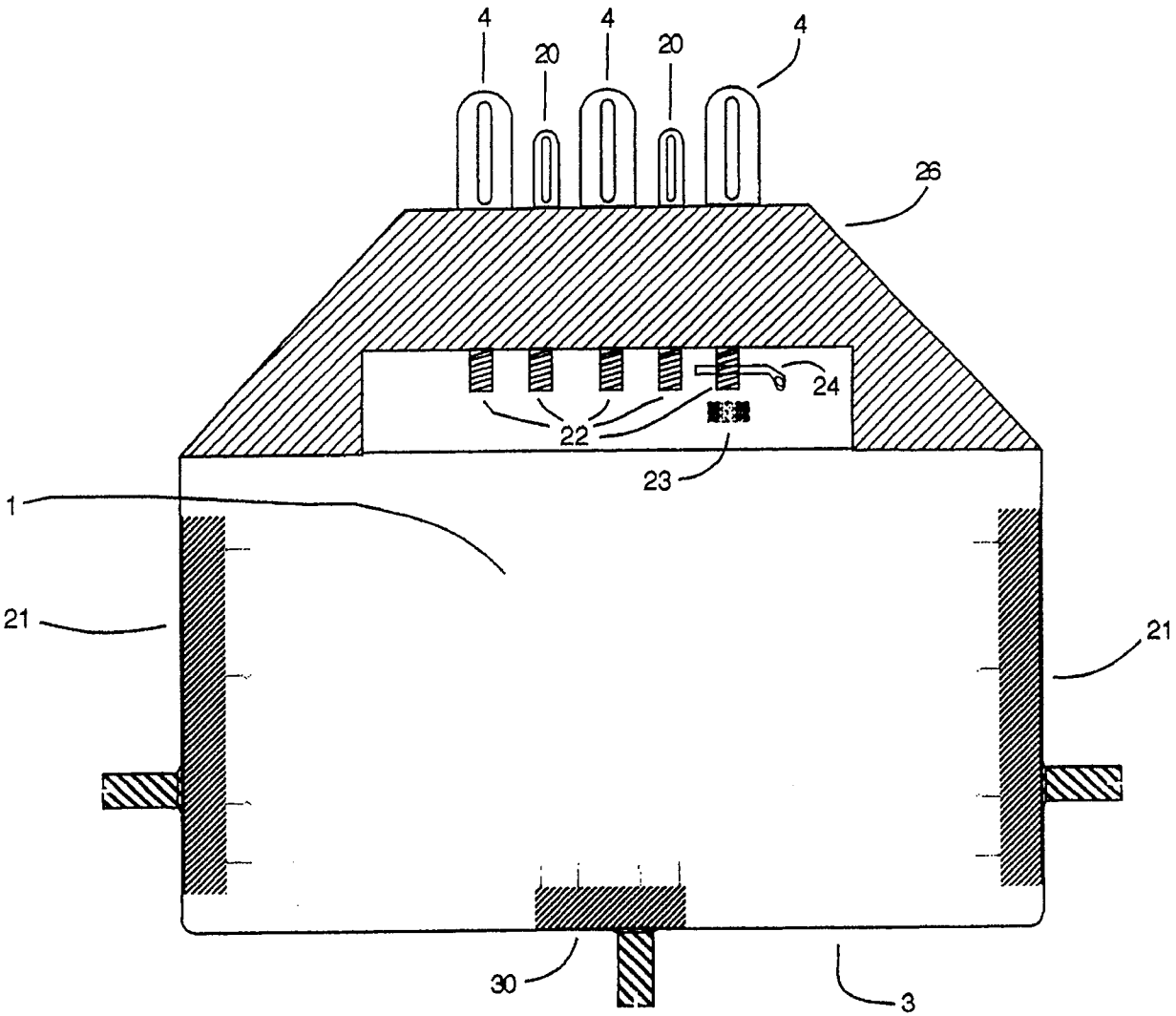
FIG. 6 is another back view of the transducer assembly in FIG. 3 which shows the preferred location of slide potentiometers and/or switches to control the output of the transducer connected to the plugs.

FIGS. 3 and 6 show the preferred location for potentiometers or switches 21 and 30 to be positioned within the casing 3 of the transducer assembly 1 which would process the signals from the transducer 17 and/or an independent electronic device 31 and 90 FIGS. 8–11 show electronic schematics for the functioning of these controls 21 and 30.

The transducer assembly 1 which will mate with the receptacle 2 may embody three plugs 4, or five plugs 4 and 20. The minimum requirement is to have the transducer assembly 1 embody three plugs 4, which will equal the number of conductors available with a standard ¼" phone output jack 7. Three large plugs 4 are also the minimum number of plugs required in order for the transducer assembly 1 to remain securely attached to the receptacle 2 during the normal motions of playing the instrument.

If the transducer assembly 1 embodies all five plugs 4 and 20, the signals from an independent electronic device 31 received via the input sleeves 19 of the receptacle 2 by the input plugs 20 of the transducer assembly 1. The signals received by these input plugs 20 may be directed through and/or processed within the casing 3 of the transducer assembly 1 before being connected to the output plugs 4, the output sleeves 12, the multi-conductor cable 5, and the output jack 7. FIG. 2 shows the independent electronic device 31 located in the common position for piezo transducers to be installed in guitars.

If only the three plugs 4 are attached to the transducer assembly 1, it will not be possible to receive the signals from any independent electronic device 31 and 90 within the casing 3 of the transducer assembly 1. Only the signals from transducers/components enclosed with the casing 3 of the transducer assembly may be connected to the output plugs 4.

The transducer assembly 1 may embody pole pieces 29, or similar visible components or indicators which comprise the transducer. These may include, but are not limited to, lights, gauges, monitors, sound emitters, and other visual or audio components.

The preferred type of plug 4 and 20 is the banana plug. Banana plugs are available in two standard sizes. The larger plug has a spring diameter of 0.170" and will be used for the output plugs 4. The smaller plug has a spring diameter of 0.120" and will be used for the input plugs 20.

Figure 12:
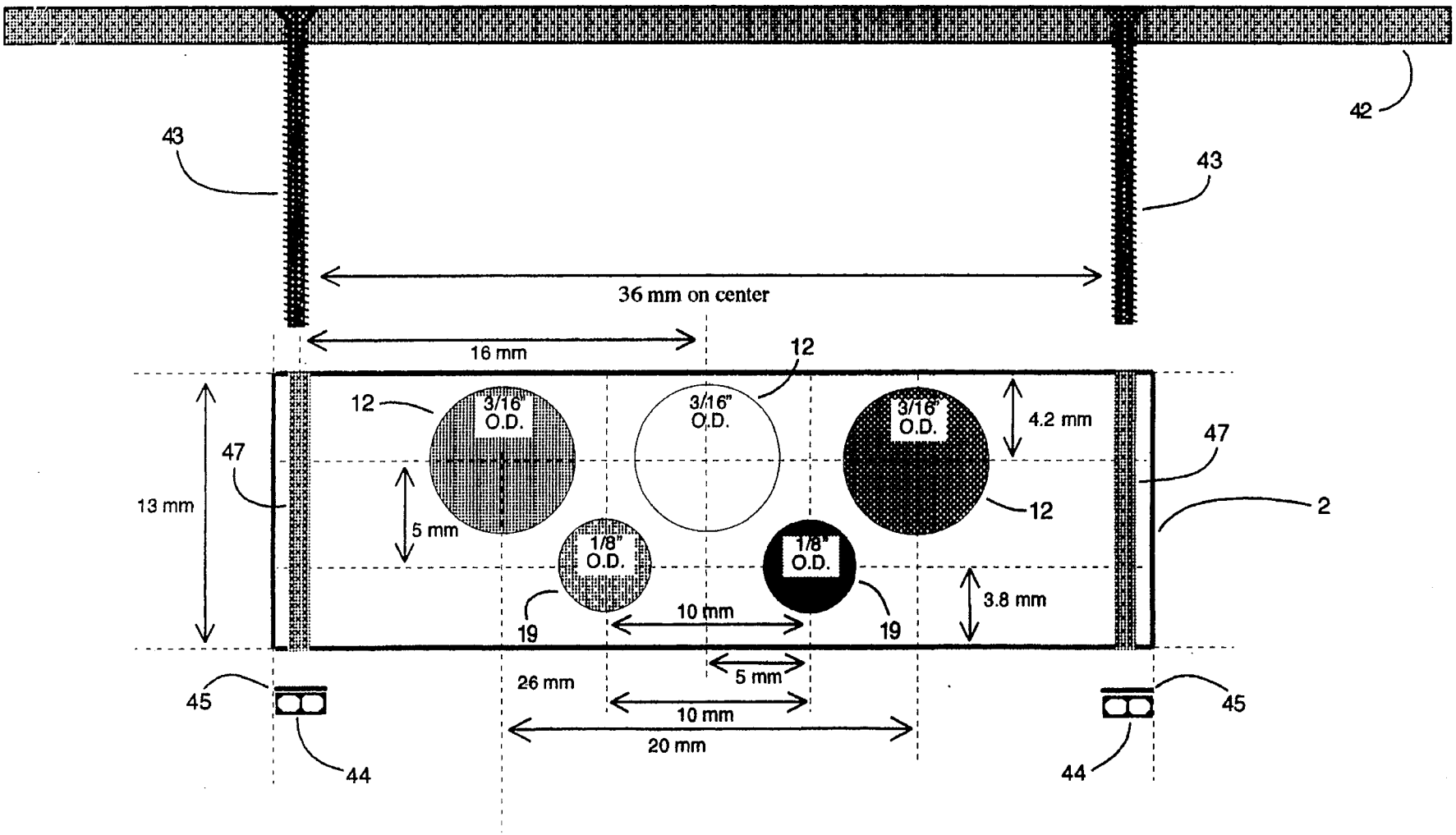
FIG. 12 is the front view of the receptacle providing detailed information regarding the preferred diameters and spacing of the sleeves, and information regarding how the receptacle is affixed to a mounting pad composed of wood or a similar material which is glued to the underside of a guitar's soundboard near the soundhole.

FIG. 12 provides specific information about the construction and mounting of the receptacle 2, which embodies five sleeves 12 and 19 in two separate rows. The first row, nearest the mounting pad 42, is composed of three large sleeves 12, which have an outside diameter of approximately 3/16" (0.1875") and an inside diameter of approximately 0.159". Sleeves 12 are spaced ten millimeters apart on center. The second row is composed of two sleeves 19, which have an outside diameter of approximately ⅛" (0.125") and an inside diameter of approximately 0.097". Sleeves 19 are spaced ten millimeters apart on center and spaced five millimeters beneath the plugs 12. The sleeves 19 of the second row are positioned in an offset pattern relative to the sleeves 12 of the first row so that the centers of sleeves 19 are midway (5 mm) between the centers of the sleeves 12. The inside diameters of the sleeves 12 and 19 will accept the standard banana plug sizes of 0.170" and 0.120", respectively. This spacing of the sleeves 12 and 19 and plugs 4 and 20 will create an efficient and space-saving pattern of conductors at the same time there is sufficient separation for each conductor to remain independent.

FIG. 12 also shows the receptacle 2 affixed to a mounting pad 42 composed of wood or similar material via two machine screws 16 which pass through tubular channels 47 in the receptacle, and are captured by hex nuts 44 with flat washers 45. The mounting pad 42 is attached to the musical instrument with an adhesive. For a violin 8, the mounting pad 42 and receptacle 2 are affixed to the underside of the fingerboard 9. For a guitar, the mounting pad 42 and receptacle 2 are affixed to the underside of the soundboard 13 near the soundhole be. If desired, it would be possible to substitute a mounting pad 91, similar to that shown in FIG. 32, for the mounting pad 42 of FIG. 12.

Figure 13:
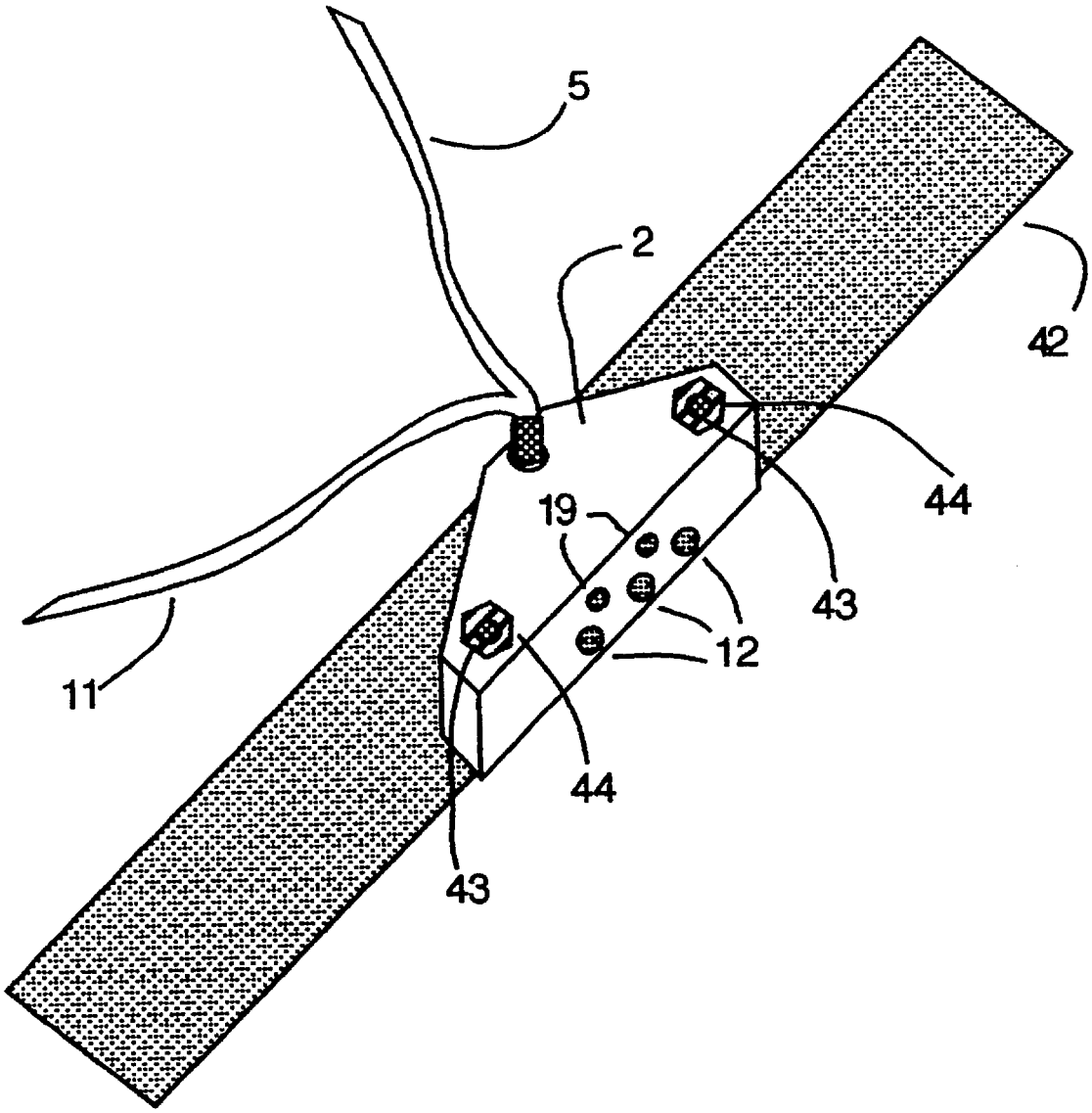
FIG. 13 is the perspective view of the receptacle in FIG. 12 which embodies five sleeves, will mount on the underside of a guitar's soundboard, and will receive the plugs mounted onto the transducer assemblies in the figures of this document.

FIG. 13 shows a perspective view of the receptacle 2 attached to the mounting pad 42.

Figure 14:
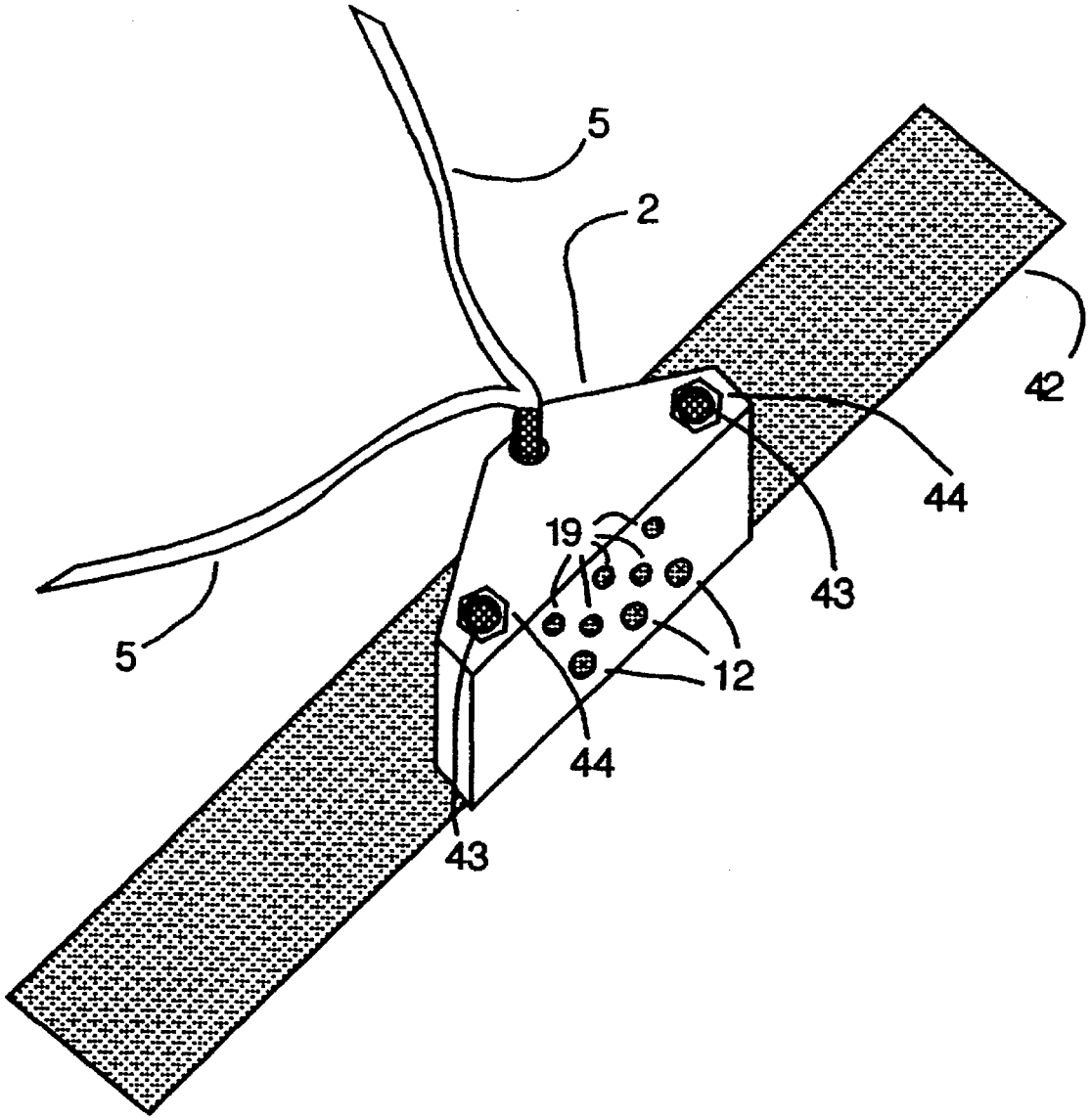
FIG. 14 is a perspective view of a receptacle similar to that of FIG. 13 which embodies 8 sleeves.

FIG. 14 shows a variation of FIG. 12 where the receptacle 2 embodies eight sleeves 12 and 19. These additional three sleeves 19 will be ⅛" in outside diameter, and be placed in a third row (relative to the mounting pad 42). The spacing of the sleeves in the third row will be 10 mm apart on center and 5 mm beneath the two ⅛" outside diameter sleeves 19 of the second row. The centers of the sleeves 19 of the third row will be spaced directly in line with the centers of the sleeves 12 in the first row. The three sleeves 19 of the third row may be dedicated to any required input or output function. This will permit any transducer assembly 1 to add three new plugs 20, bringing the total number of plugs on the transducer assembly to eight. At the same time, any transducer assembly 1 which embodies only three plugs 4, or five plugs 4 and 20, will be capable of mating with this new receptacle 2 which embodies eight sleeves 12 and 19.

Figure 15:
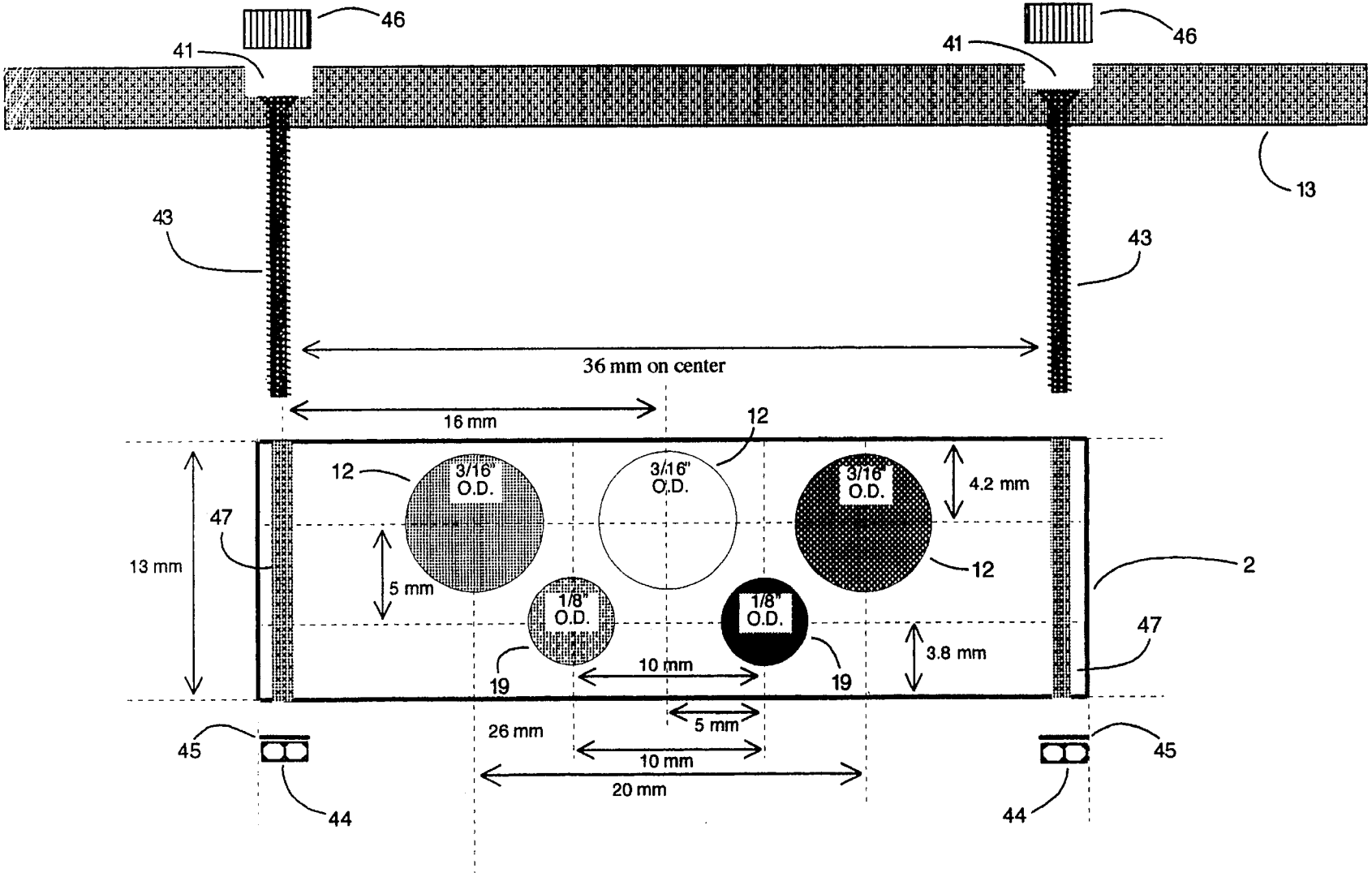
FIG. 15 is another front view of the receptacle in FIG. 12 which provides information of an alternative method to mount the receptacle directly to the soundboard of a guitar via machine screws embedded in the soundboard underneath the rosette which surrounds the soundhole.

FIG. 15 shows an alternative version for attaching the receptacle 2 to the soundboard 13 which eliminates the need for a mounting pad 42. In FIG. 15, the machine screws (or threaded inserts) 43 are attached directly to the soundboard of the guitar within the channel 41 of the inlaid rosette 46 which normally surrounds the soundhole of acoustic guitars. The machine screws 43 are captured by hex nuts 44 with washers 45 which attach the receptacle 2 to the soundboard 13 of the guitar.

Figure 16:
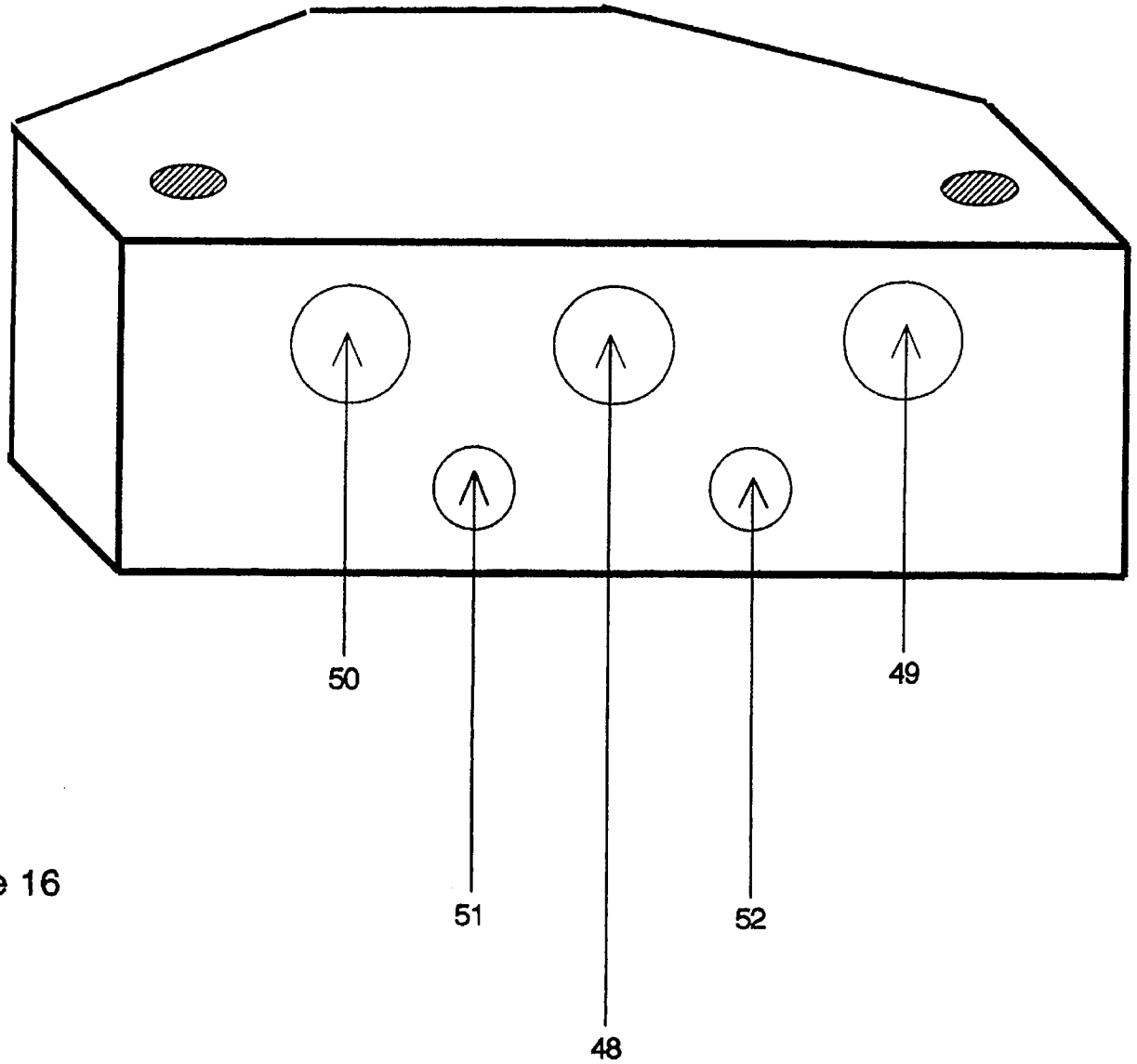
FIG. 16 is a front view of the receptacle in FIG. 12 which shows the conductive orientation of the sleeves relative to the output jack and an independent electronic device.

FIG. 16 shows the conductive orientation of the sleeves 12 and 19 in the receptacle 2. Sleeve 50 is the primary positive (+) conductor connected to the lip terminal of the output jack 7. Sleeve 49 is the secondary positive (B+) output conductor connected to the ring terminal of the output jack 7. Sleeve 48 is the negative (–) output conductor connected to the shield terminal of the output jack 7. Sleeve 52 is the positive (+) input conductor from an independent electronic device. Sleeve 51 is the negative (–) input conductor from an independent electronic device.

Figure 4:
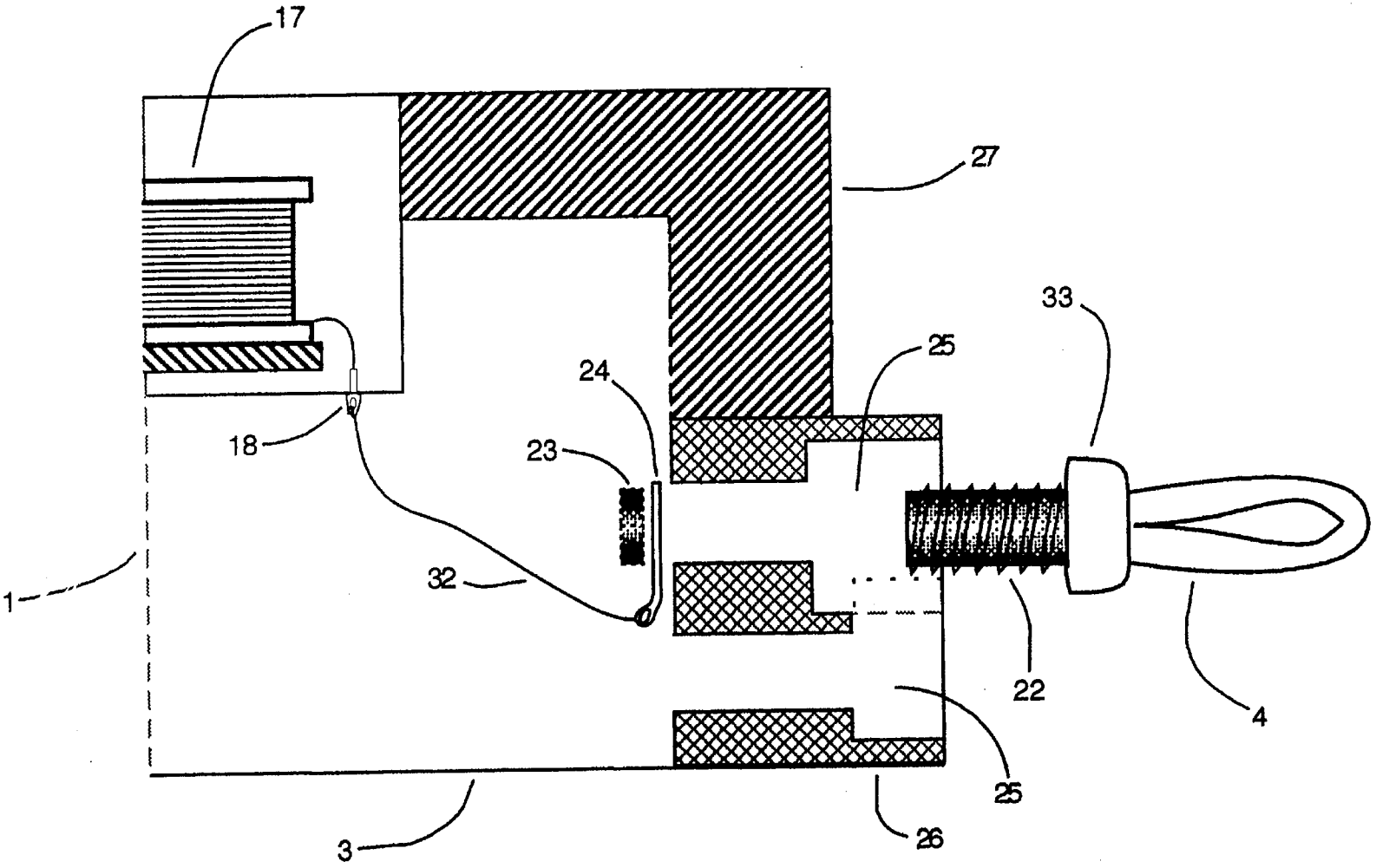
FIG. 4 is a detailed cut-away side view of the transducer assembly in FIG. 3 which displays more specific information regarding the mounting of the banana plugs onto the casing of the transducer assembly via hex nuts.
Figure 5:
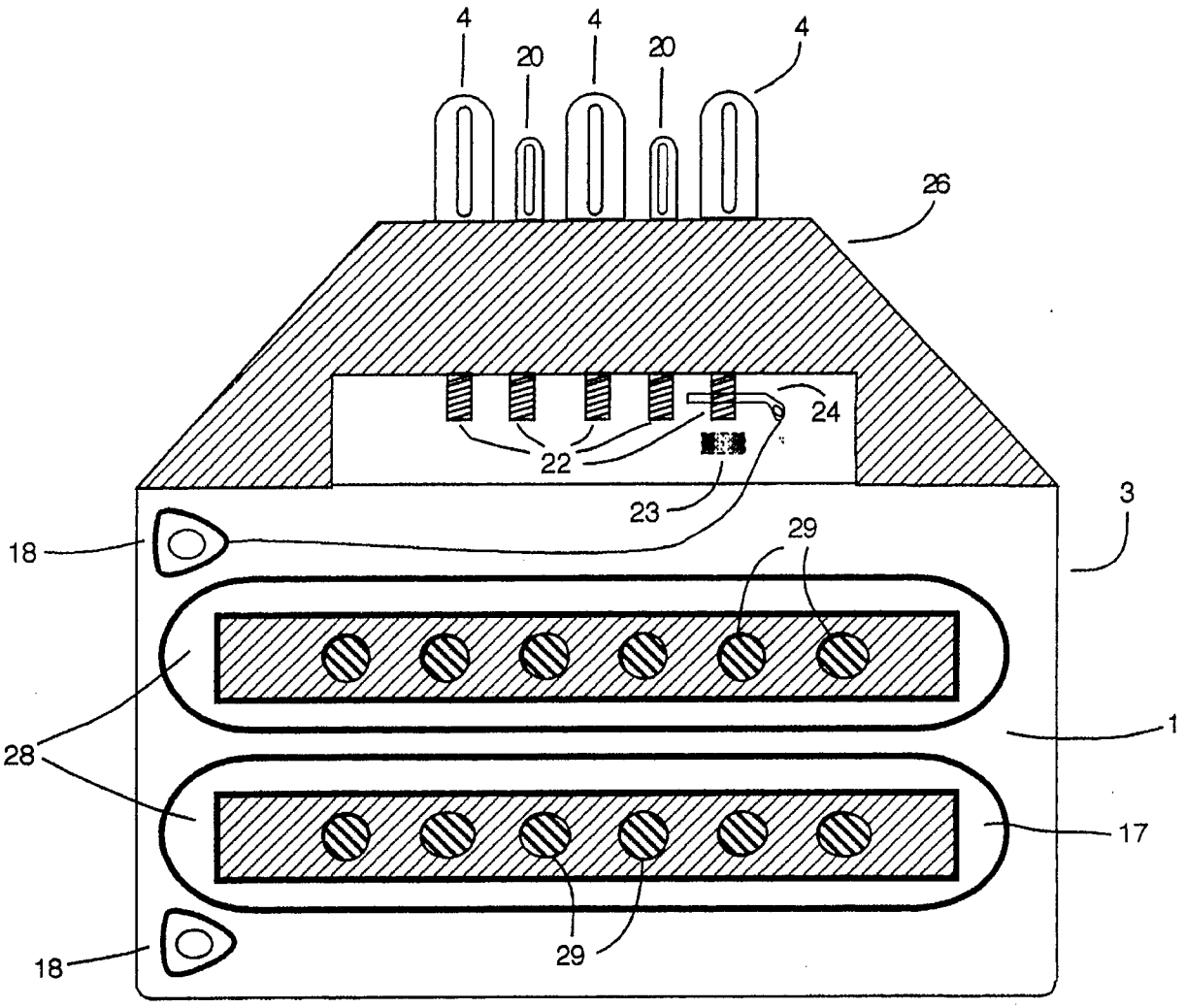
FIG. 5 is the back view of the transducer assembly in FIG. 3 with the coverplate removed, and provides more information regarding the spacing of the banana plugs and the location of the transducer.
Figure 7:
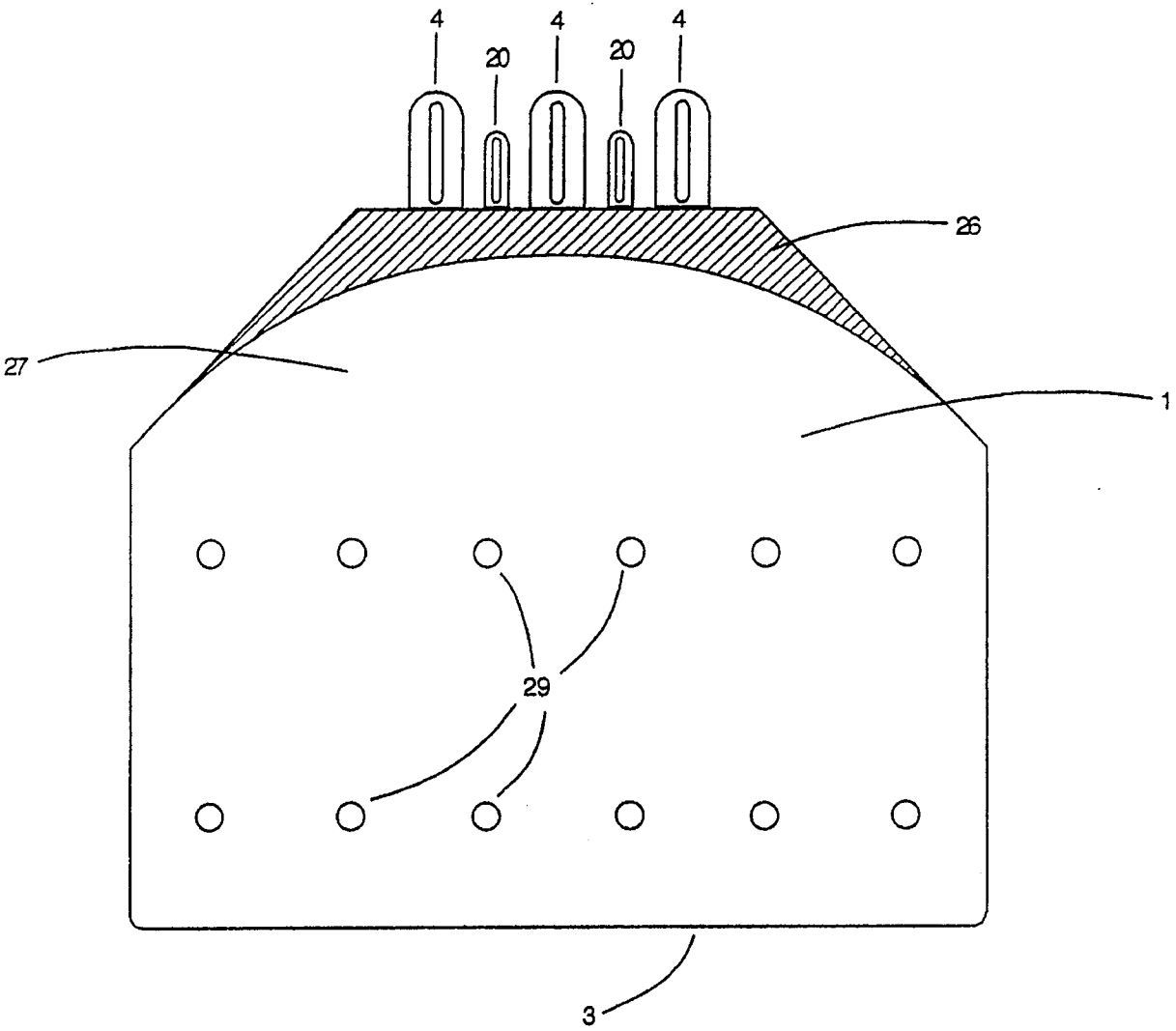
FIG. 7 is the top view of the transducer assembly in FIG. 3 which provides details regarding contouring the casing for the device in the vicinity where the plugs are attached.
Figure 8:
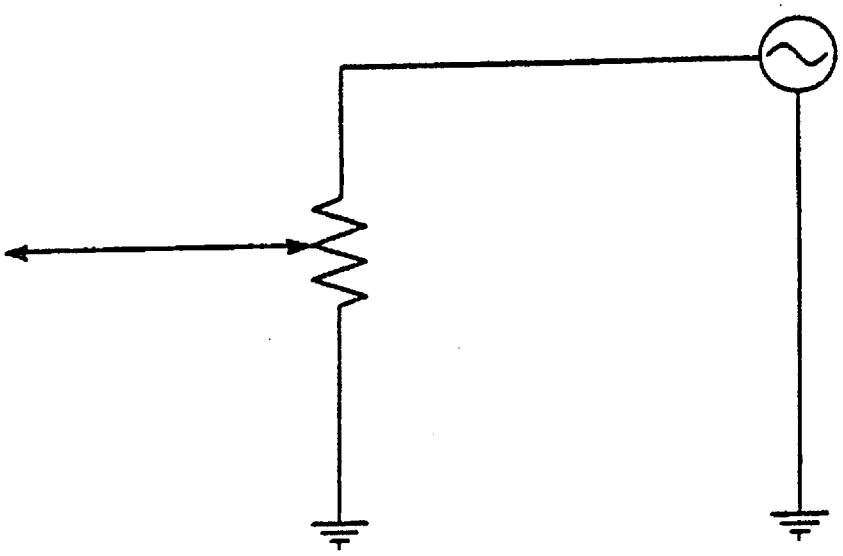
FIG. 8 is an electronic schematic showing a volume control for a single transducer enclosed within the transducer assembly in FIGS. 3–7.
Figure 9:
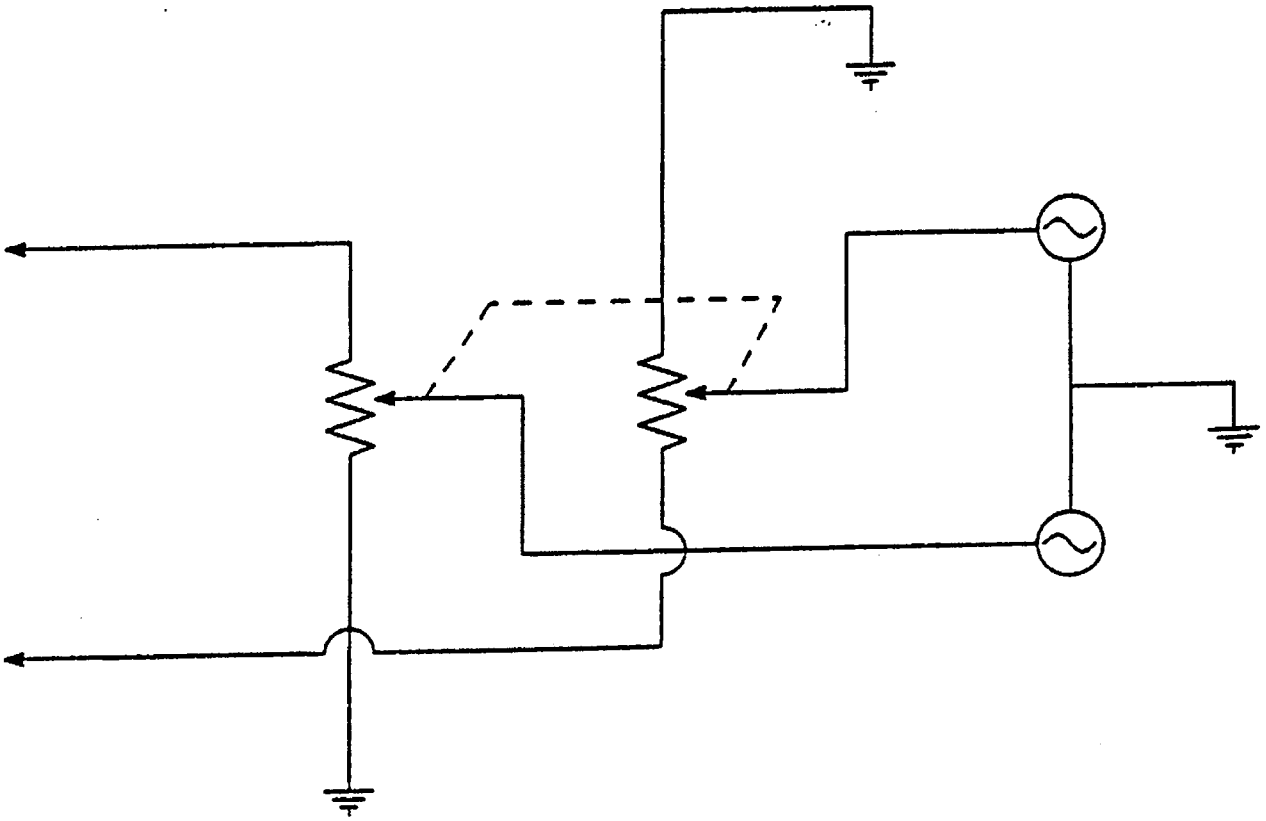
FIG. 9 is an electronic schematic showing volume and blend controls for two transducers connected to separate outputs.
Figure 10:
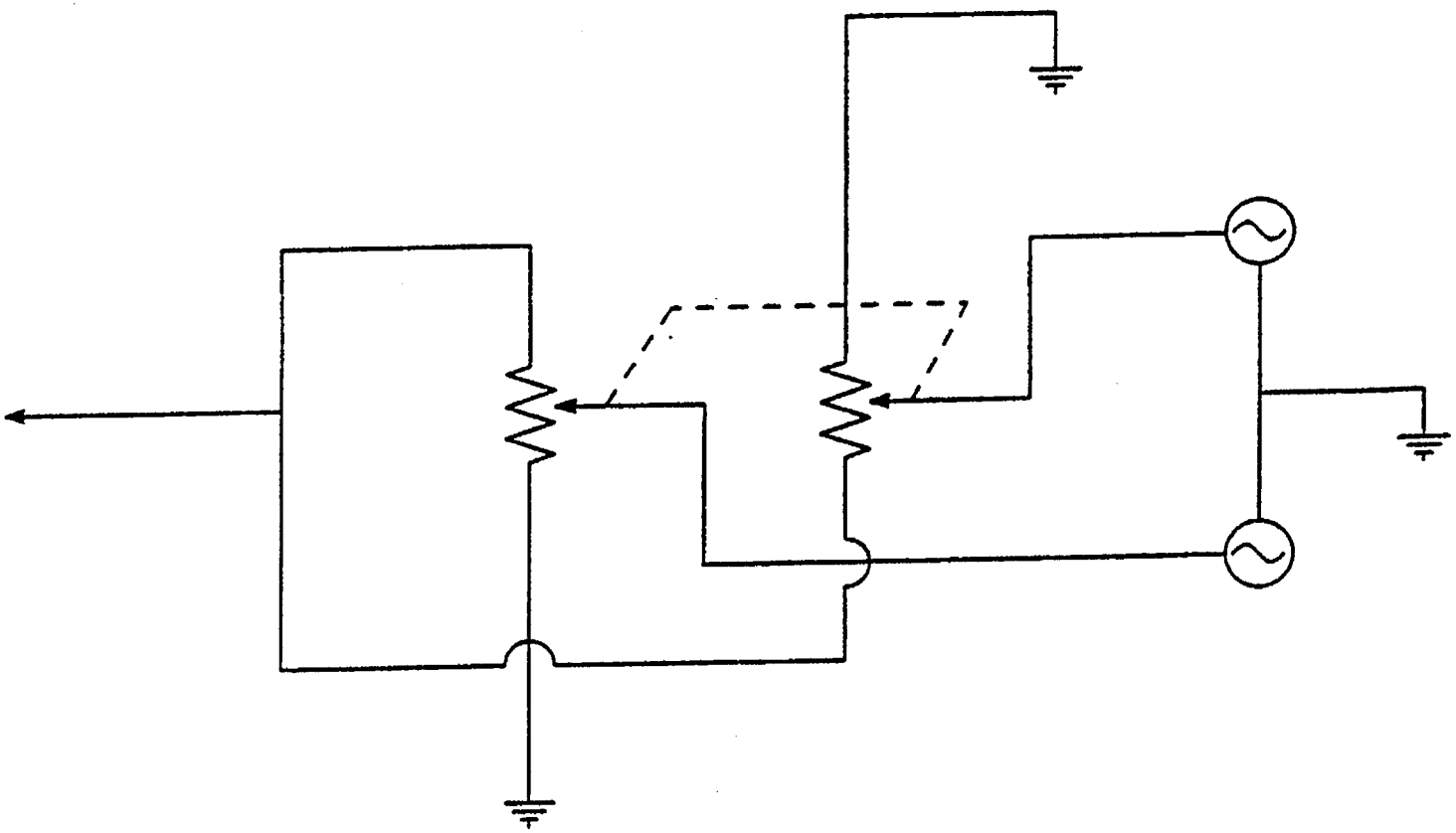
FIG. 10 is an electronic schematic showing volume and blend controls for two transducers connected to a single (common) output.
Figure 11:
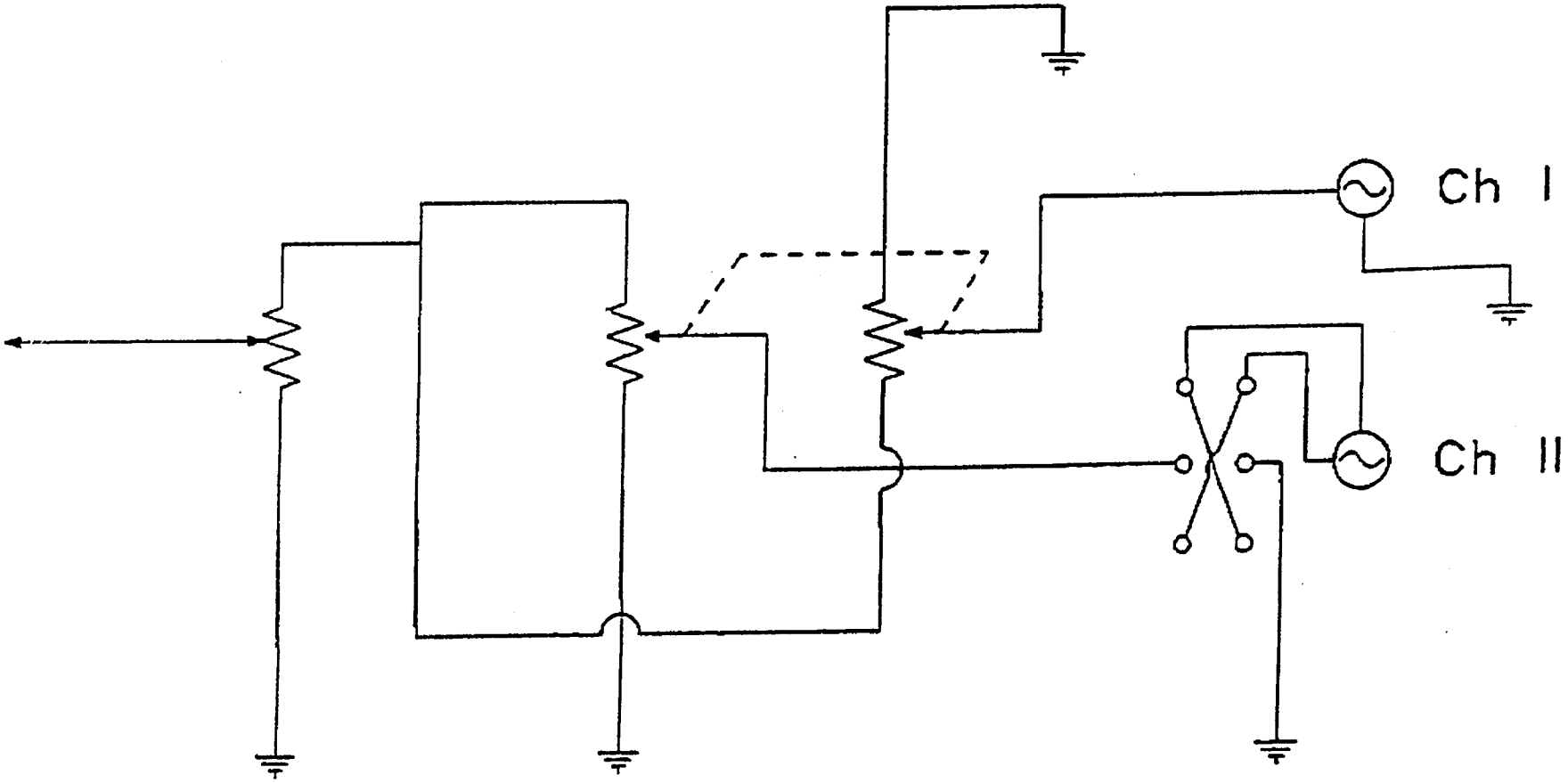
FIG. 11 is an electronic schematic showing volume and blend controls for two transducers connected to a single (common) output, with a phase reversal for one of the transducers.

Both the exterior of the receptacle 2 and transducer assembly 1 will be fully shielded by conductive metal, metallic foil, or shielding paint to avoid interference from outside electronic sources. FIGS. 3, 4 and 7 provide detailed information about how this will be accomplished. The shoulder 33 of the plugs 4 and 20 will rest in recesses 25 of the casing 1, and be attached to the casing by a threaded shaft 22 captured by a washer-terminal 24 and hex nut 23. The washer-terminal 24 will be electronically connected to the outputs 18 of the transducer 17 by a signal wire 32. When the lower face 26 of the transducer assembly 1 abuts the receptacle 2, all of the plugs 4 and 20 will be enclosed by the shielded casing 3, leaving no conductive surfaces exposed. At the same time, the upper face of the casing 27 is recessed and curved to follow the contours of the soundhole 10 of an acoustic guitar 14, so that no parts of the transducer assembly 1 will touch the guitar 14 when the transducer assembly 1 is engaged to the receptacle 2. The back of the transducer assembly 1 will be covered and shielded by a coverplate 15 which attaches to the casing 3 with a screw 16 or similar mechanism to complete the shielding process.

Figure 17:
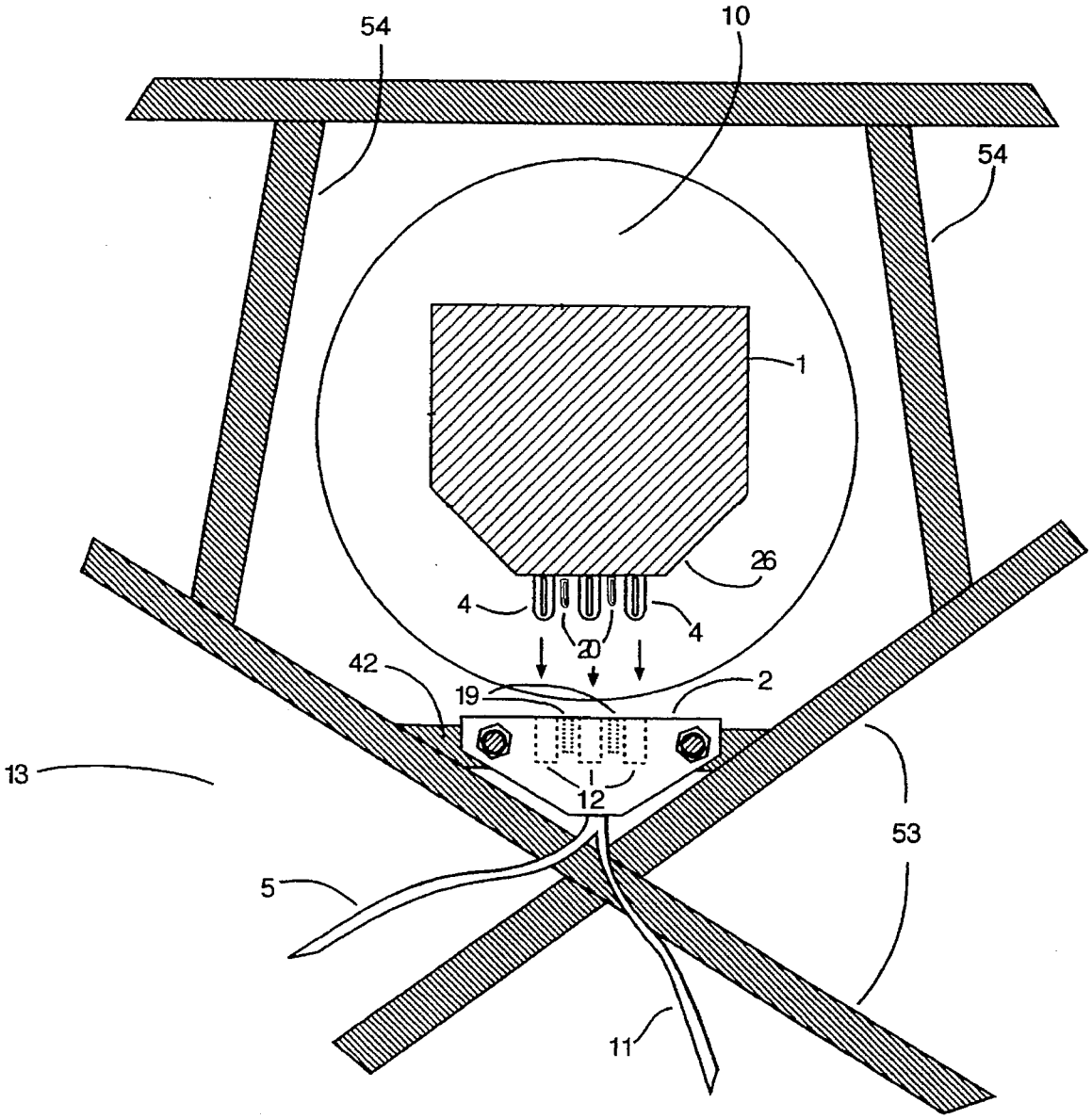
FIG. 17 is a view from inside an acoustic guitar showing the receptacle installed between the "X" braces with the plugs of a transducer assembly positioned to be received by the sleeves of the receptacle.

FIG. 17 shows a view from inside an acoustic guitar where the receptacle 2 is installed onto the soundboard 13 between the braces 53. Such an "X" brace configuration is the most common type of bracing pattern used for acoustic guitars. The mounting pad 42 is trimmed to fit the space available between the "X" braces 53 and is then affixed to the soundboard 13 with an adhesive. This figure displays the underside view of the transducer assembly 1 shown in FIG. 20, which embodies five plugs 4 and 20 which will be received by the five sleeves 12 and 19 of the receptacle 2.

Figure 18:
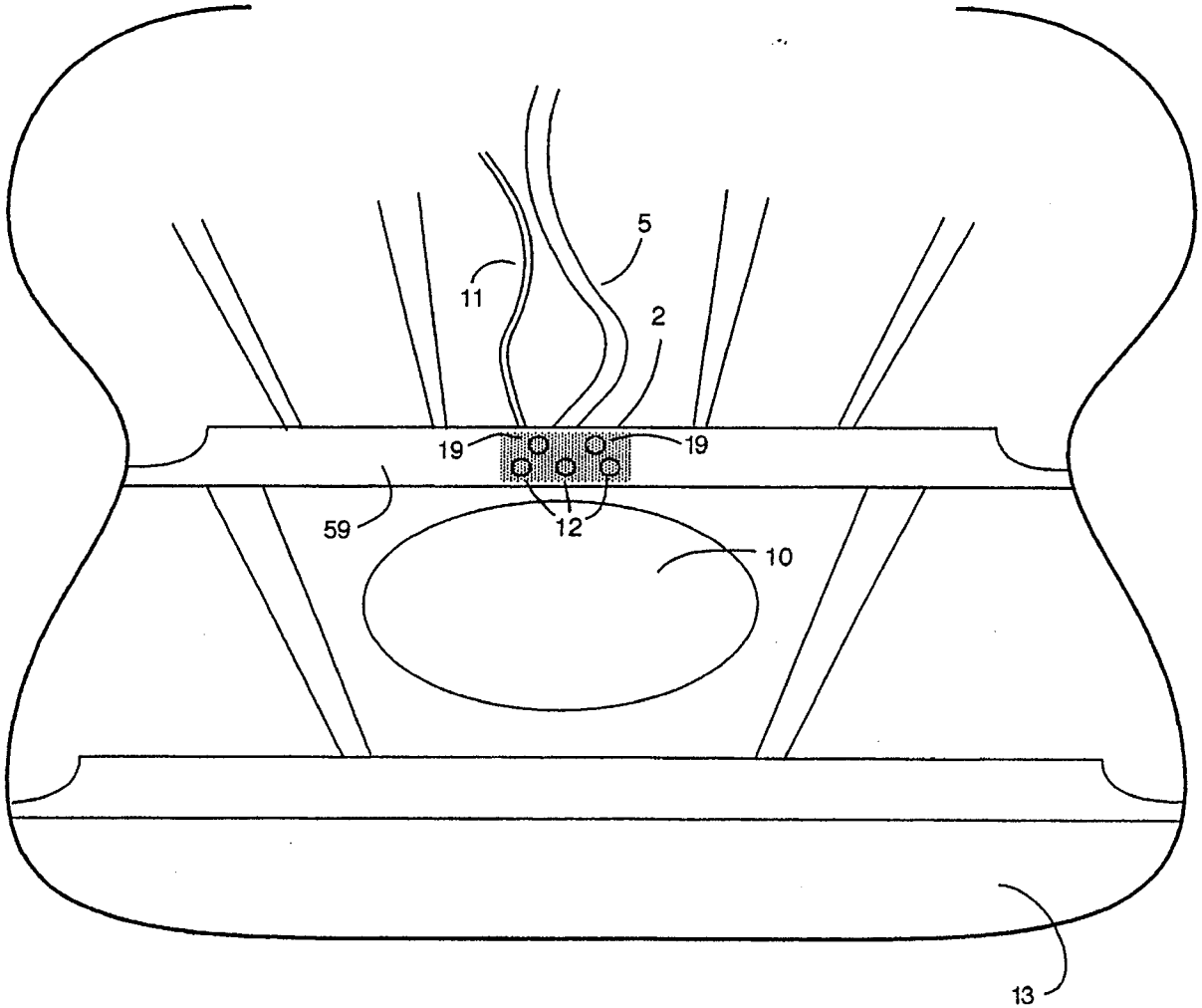
FIG. 18 shows the receptacle in FIG. 12 being mounted into a lateral brace near the soundhole of a guitar.

FIG. 18 shows the receptacle 2 being mounted into a lateral brace 59 which transverses the soundboard 13 near the soundhole 10 of a guitar 14. This is the second most common type of bracing pattern used for acoustic guitars. The presence of the lateral brace 59 near the soundhole 1 prohibits the use of a separate receptacle 2 as shown in other figures of this document.

Figure 19:
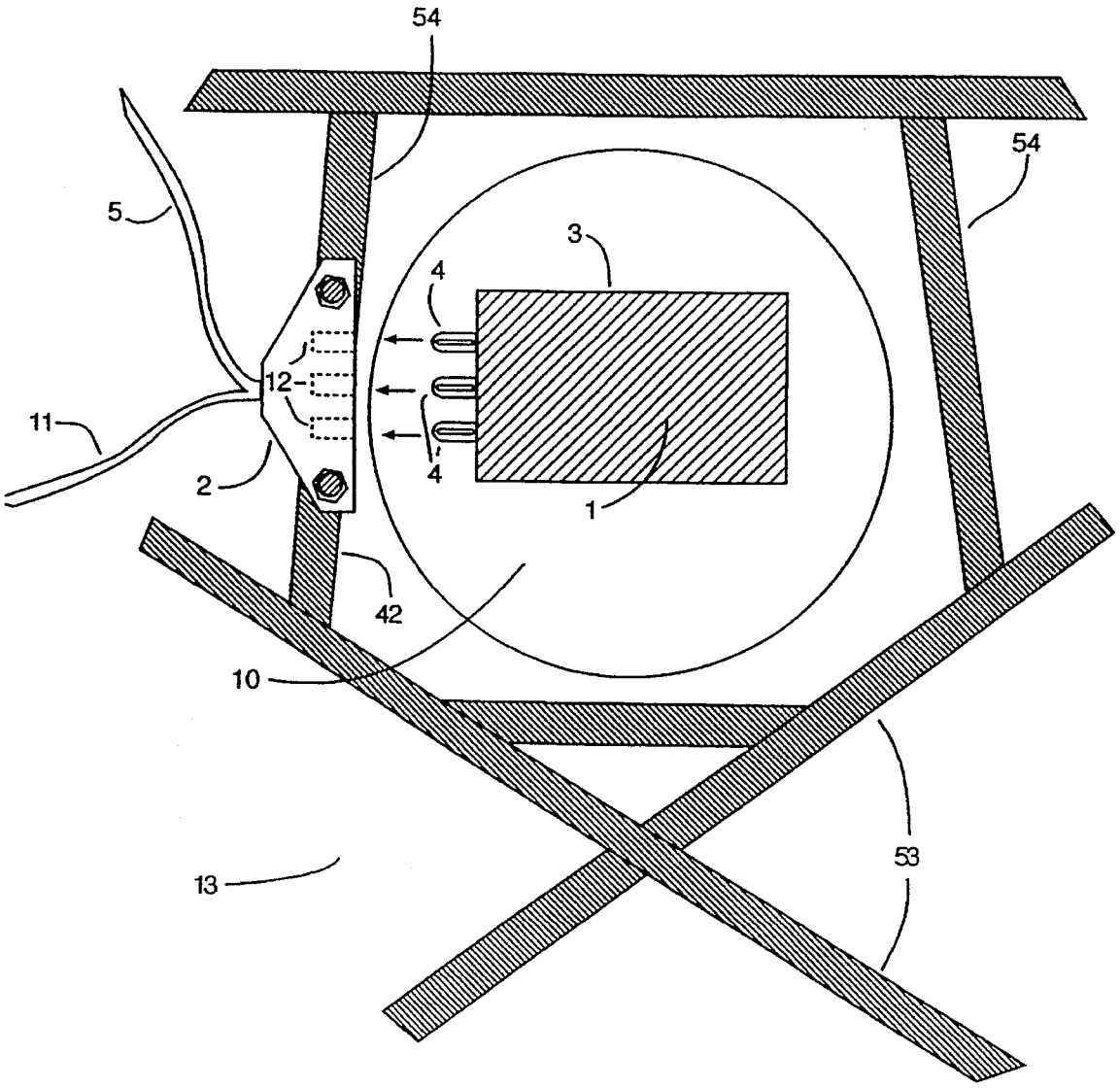
FIG. 19 shows the plugs attached to the transducer assembly mounted onto the end of the casing with a receptacle installed to receive these plugs.

FIG. 19 shows the plugs 4 being mounted onto the end of a transducer assembly 1 with the receptacle 2 being positioned onto the underside of the soundboard 13 near the side of the soundhole 10.

FIGS. 20–24 show alternative transducers being used. These figures all show the use of only three plugs 4 on the transducer assembly 1. But, it is possible that five plugs, potentiometers, switches, etc. may be used as well. The plugs 4 are affixed to the casing 3 of the devices in a manner similar to FIG. 4. The casing 3 may also serve to house a battery (not shown) or other electronic components (not shown) required to service the transducer(s).

Figure 20:
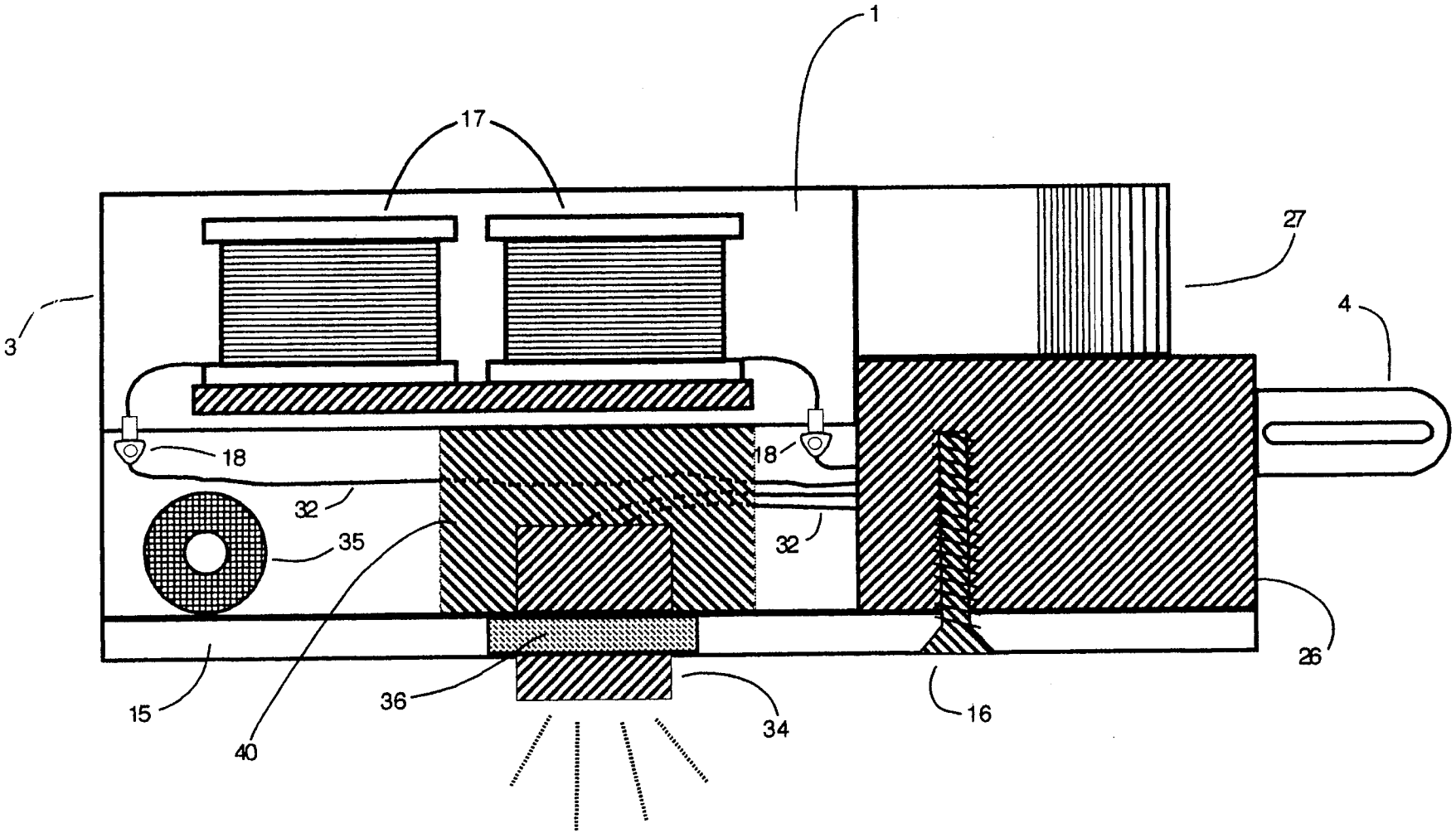
FIG. 20 is the cut-away side view of a transducer assembly which embodies two separate transducers within a single casing in the form of a magnetic pickup and a microphone.

FIG. 20 displays a cut-away side view of a transducer assembly 1 which incorporates both a magnetic pickup 17 and a microphone 34 mounted within a foam block 40 for individual or simultaneous use. An opening 36 is cut in the coverplate 15 to permit the active face of the microphone 34 to be exposed to the movement of vibrating air inside the guitar 14.

Figure 21:
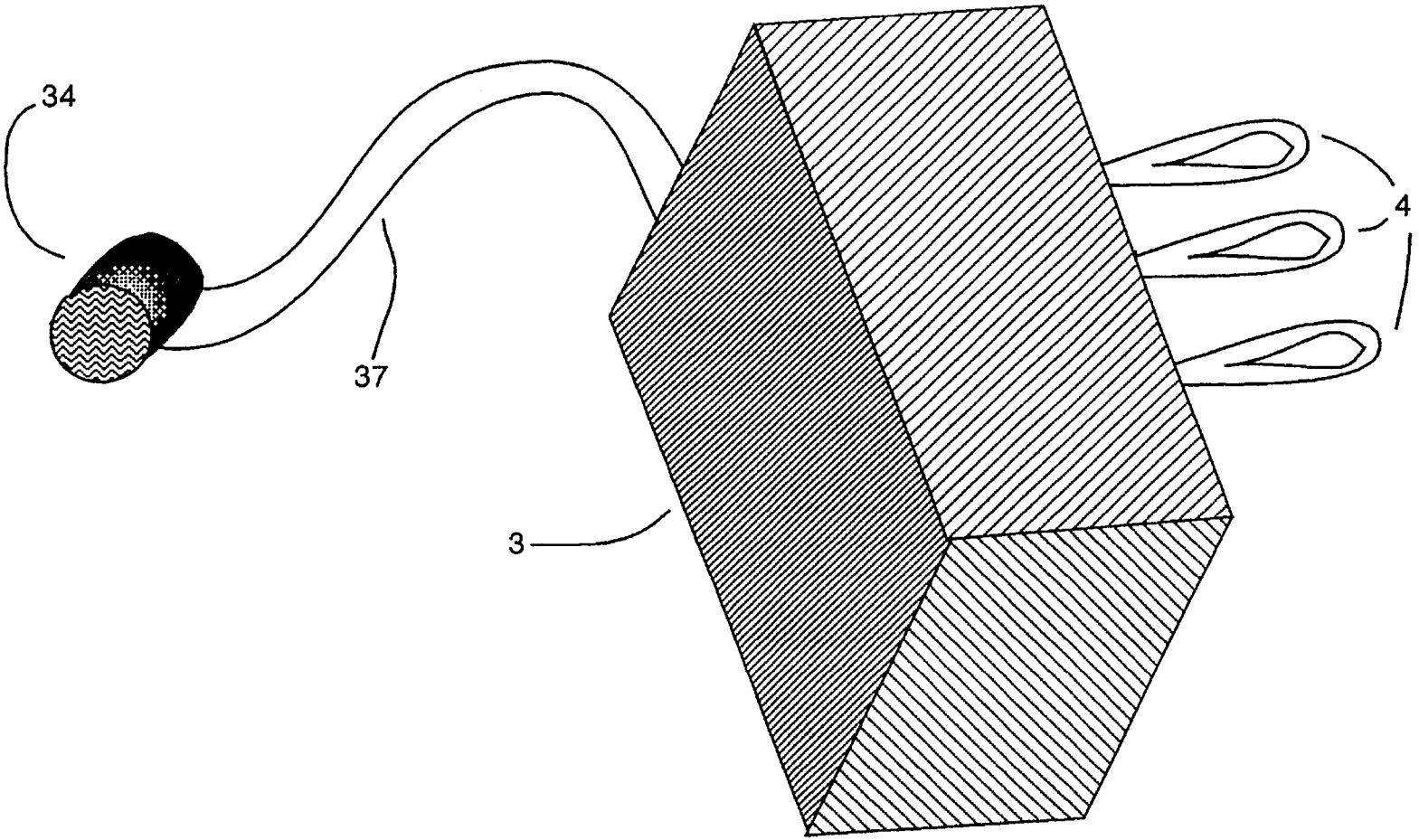
FIG. 21 is a perspective view of a transducer assembly which embodies a microphone attached to a flexible shaft, or gooseneck.

FIG. 21 shows a microphone 34 mounted onto a flexible shaft 37 which emerges from the casing 3.

Figure 22:
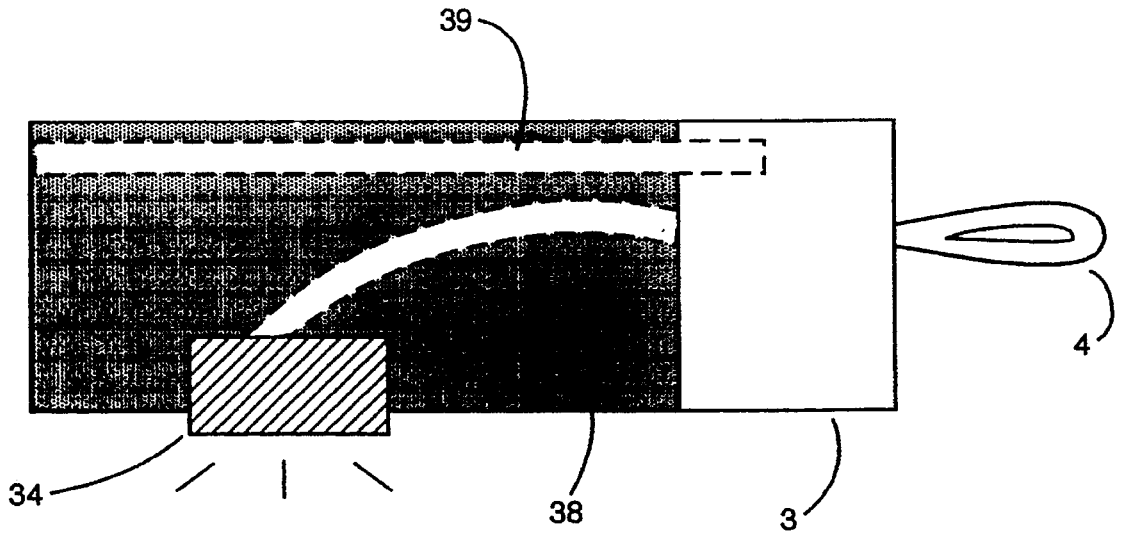
FIG. 22 is the side view of a transducer assembly which embodies a microphone embedded in a foam disk.

FIG. 22 shows the side view of a transducer assembly employing a microphone 34 which is embedded within a foam disk 38. The active face of the microphone 34 emerges from the underside of the disk 38. When mated to a receptacle 2 installed in an acoustic guitar 14, the active face of the microphone 34 will point towards the interior of the guitar 14 and thus be best positioned to record the sound energy as air moves from the interior to the exterior of the guitar 14. The disk 38 is supported by two rods 39 of metal, plastic, or similar material, which are embedded in the foam disk 38 and extend from the casing 3. In addition to supporting the microphone 34, the foam disk 38 serves to block sound energy originating from speakers outside the guitar 14 from re-entering the microphone 34. Whenever sound energy from speakers re-renters the original source microphone, unpleasant feedback may occur. Thus, by blocking this sound energy from outside speakers, the foam disk 38 will serve to reduce or eliminate feedback in the microphone 34 during use.

Figure 23:
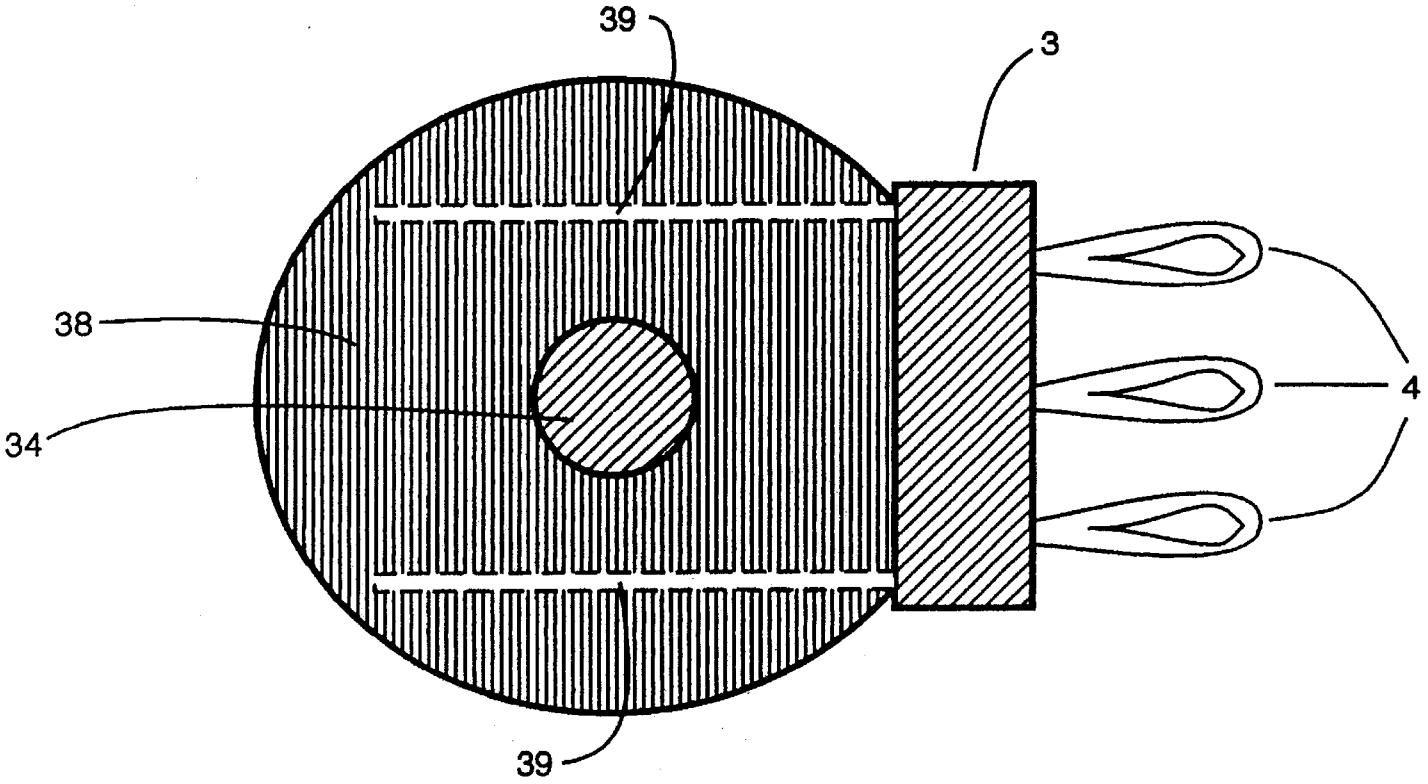
FIG. 23 is the bottom view of a transducer assembly in FIG. 22.

FIG. 23 shows a view of the underside of the transducer assembly described in FIG. 22 as it would appear from the interior of an acoustic guitar 14.

Figure 24:
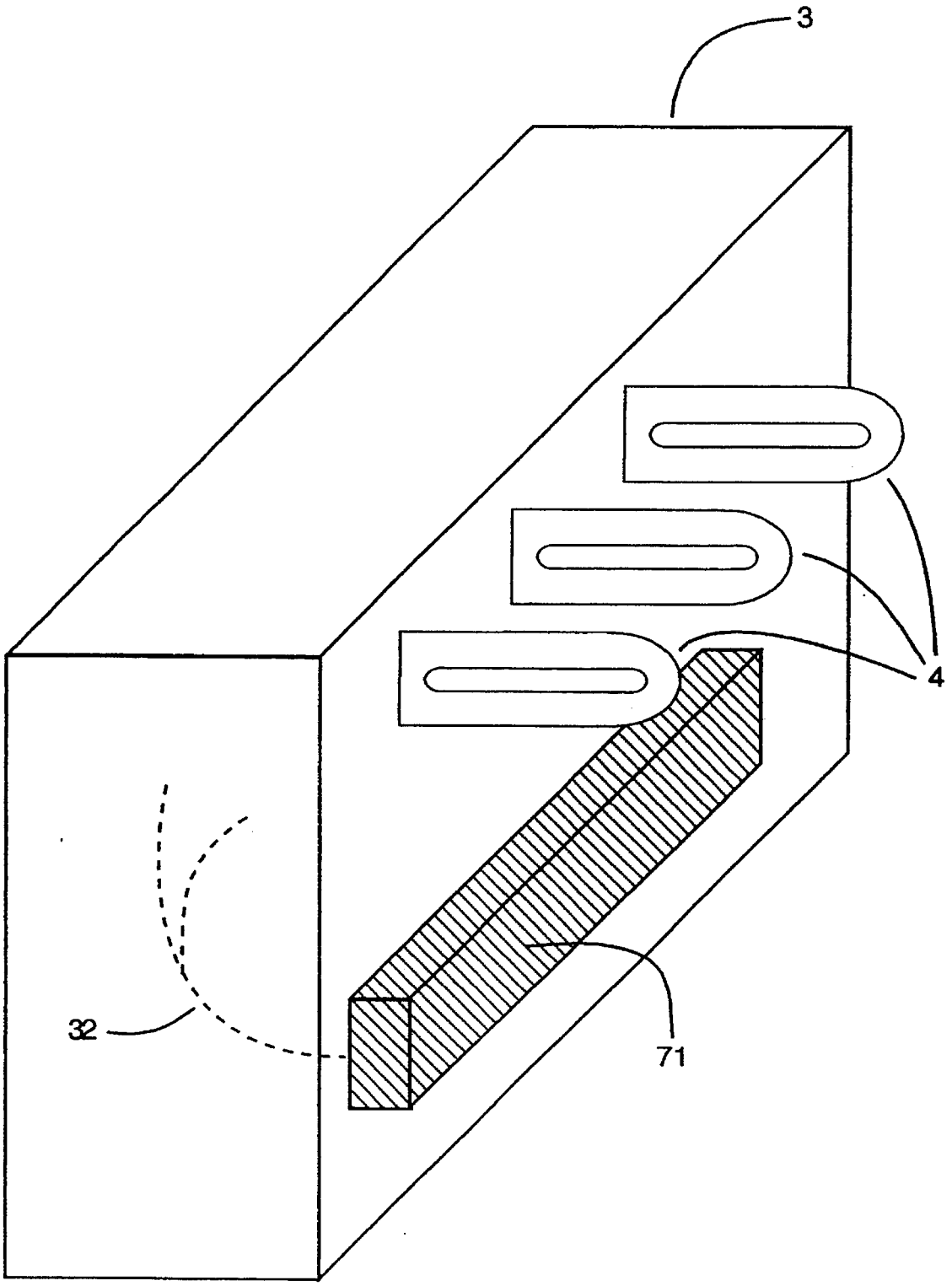
FIG. 24 shows a transducer assembly which embodies piezo crystal transducers.

FIG. 24 shows a transducer assembly 1 which embodies a piezo crystal transducer 71 which is connected to the plugs 4 via signal wires 32.

Figure 25:
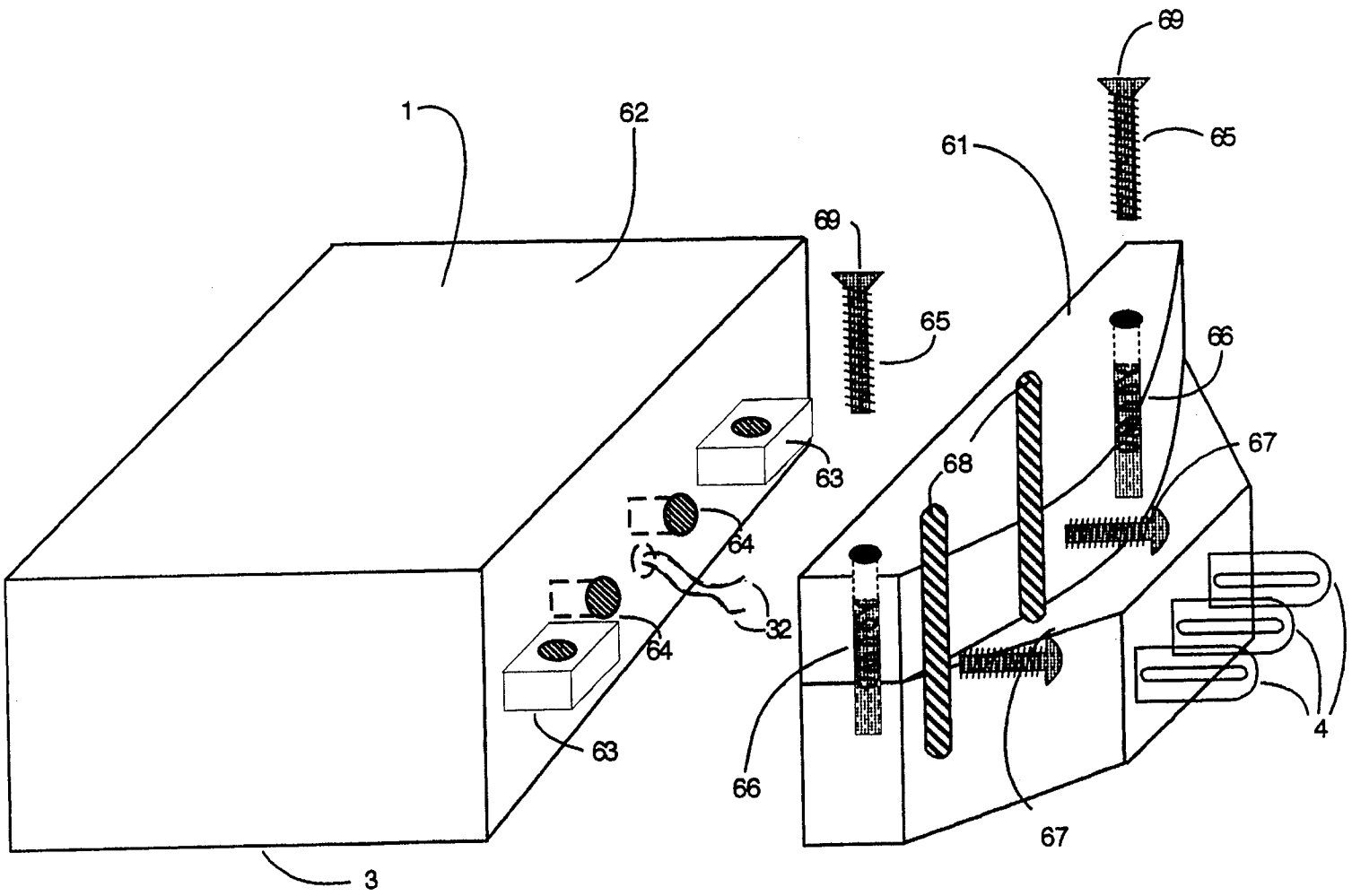
FIG. 25 is the perspective view of a transducer assembly which has height adjusting abilities for the "head" (attached to the plugs) relative to the "body" (which encloses the transducer or other components).

FIG. 25 displays a transducer assembly 1 with a two part casing that permits the part of the device enclosing the transducer to be independently adjustable relative to the strings 6 of an acoustic guitar 14 when the plugs 4 are engaged to a receptacle 2. The head (of the casing) 61 is attached to the plugs 4, while the body (of the casing) 62 encloses the transducer (not shown in this figure). If the body 62 is independently adjustable relative to the strings of a guitar, the transducer assembly 1 may be positioned in a variety of distances from the strings in order to achieve the position which will permit the best operation of the transducer. This figure displays two separate mechanisms for attaining this adjustability, and these two mechanisms can be used singularly or simultaneously. The first mechanism employs two machine screws 65 which pass through the top of the head 61 and engage the height adjusting inserts 63 attached to the body 62. "Normally open" springs 66 are embedded in the head 61 between the head 69 of the machine screw 65 and the inserts 63 in order to maintain constant pressure. The constant pressure of the springs 66 against the insert 63 will serve to hold the body 62 in place relative to the head 61. For the second mechanism, two machine screws 67 pass through slots 68 cut in the rear of the head 61 and engage the locking inserts 64 embedded within the casing 3 of the body 62. The slots 68 permit the machine screws 67 to move up or down as required by the needs of the body 62 for height adjustment. When tightened, the machine screws 67 will lock the head 61 securely to the body 62. Signal wires 32 emerge from the body 62 and electronically connect with the plugs 4 attached to the head 61 . This design will require the use of two coverplates (not shown), one each for the head 61, and one for the body 62.

Figure 26:
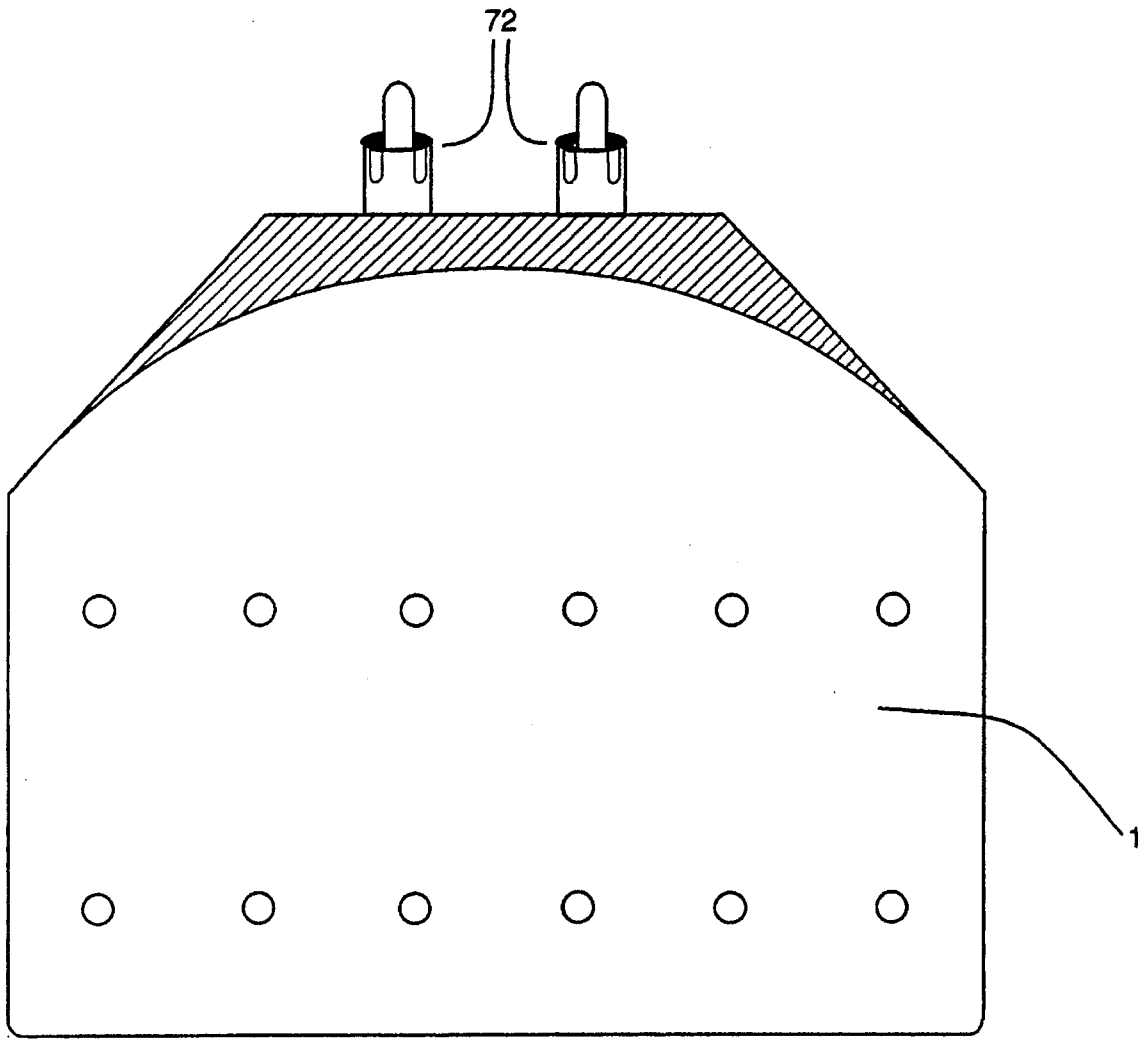
FIG. 26 is the top view of a transducer assembly which specifically employs RCA type phono plugs attached to the casing as output conductors for the transducer enclosed within the casing.

FIG. 26 shows two RCA type phono plugs 72 attached to the casing 3 of the transducer assembly 1 which will mate with a receptacle 2 which embodies two RCA type phono jacks spaced identical to phono plugs 72.

Figure 27:
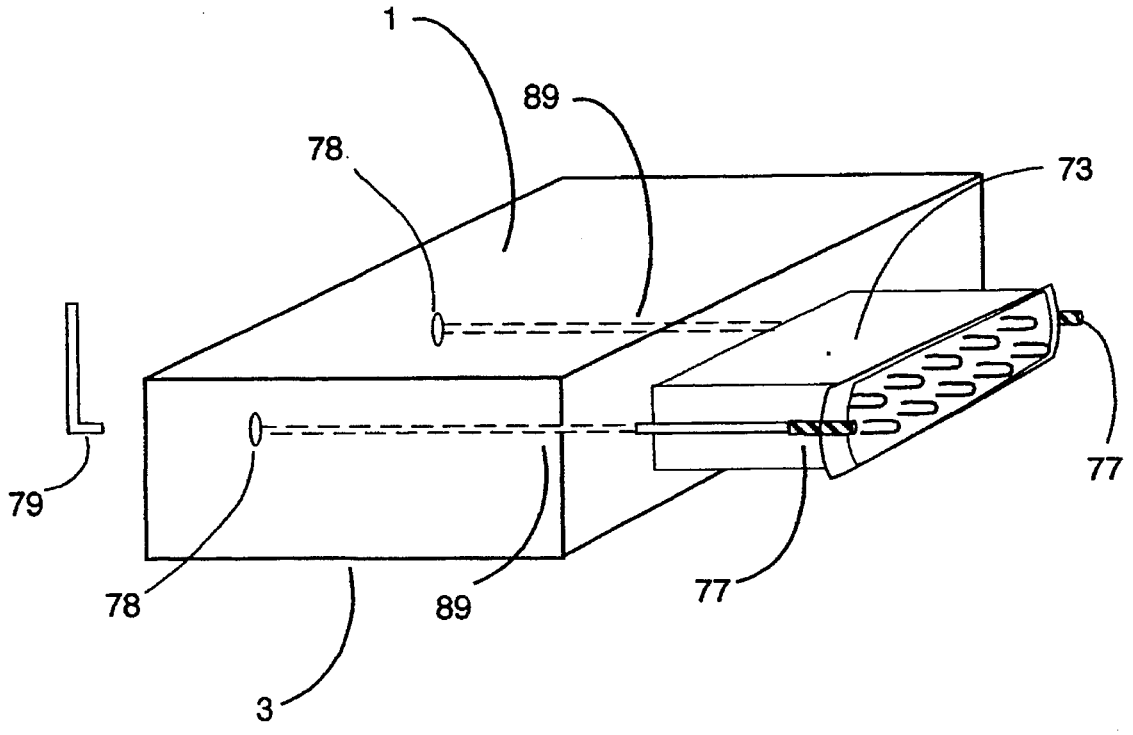
FIG. 27 is a perspective view of a transducer assembly which employs a connector of custom design attached to the casing and output conductors of the device.

FIG. 27 shows a multi-pin custom connector 73 mounted onto the casing of a transducer assembly 1. The connector 73 includes two machine screws 89 which pass through the casing 3. The head 78 of the machine screw 89 abuts the casing 3 of the transducer assembly 1, while the opposite end of the machine screw 89 embodies male threads 77. These male threads 77 are designed to engage female threads (not shown) which are embodied in a receptacle 2 designed to receive the connector 73. When such a receptacle 2 is mounted on the underside of a guitar 14, and is mated with the pins of the connector 73 attached to the transducer assembly 1, a wrench 79 may be employed to activate the machine screws 89 so that the male threads 77 will engage the female threads of the receptacle 2. Such a threaded coupling will provide the means to secure a transducer assembly 1 to the receptacle 2 of much greater weight than what is possible via the other figures of this document.

Figure 28:
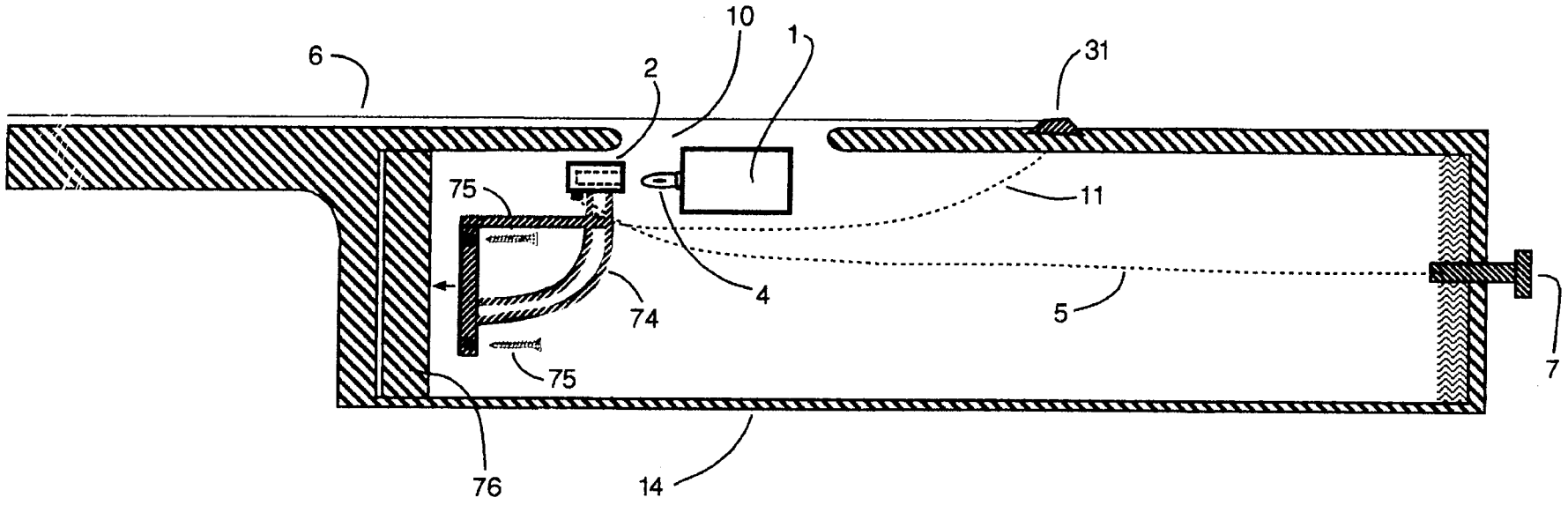
FIG. 28 is the cut-away side view of an acoustic guitar showing a receptacle mounted onto a frame which attaches to the neckblock of the guitar.

FIG. 28 shows an alternate method for mounting the receptacle 2 onto a guitar 14 via a frame 74 that attaches to the neckblock 76 via screws 75.

Figure 29:
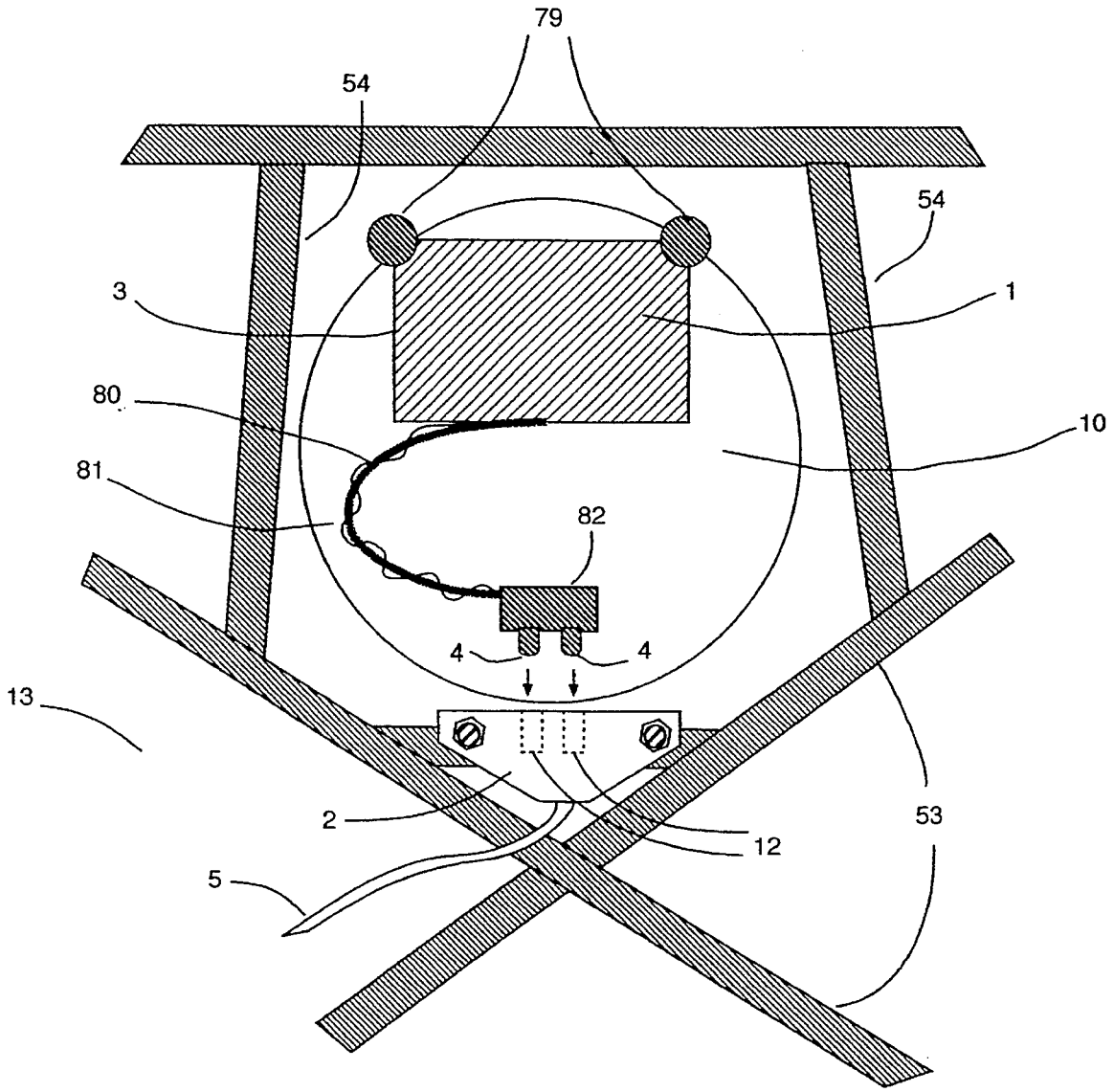
FIG. 29 shows the view from inside an acoustic guitar where a transducer assembly is mounted in the soundhole via a spring clip which embodies two output plugs which will be received by a receptacle mounted underneath the soundboard.

FIG. 29 shows a method of mounting a transducer assembly which incorporates several features displayed in the prior art figures. A transducer assembly 1, is installed inside a guitar's soundhole 10 via two slotted mounting pads 79 and a spring clip 80. The output cable 81 from the transducer assembly 1 travels down the spring clip 80 and terminates in a fixture 82 which embodies two plugs 4. These two plugs 4 are electronically connected to the output cable 81. The plugs 4 are received by two sleeves 12 enclosed within a receptacle 2 mounted on the underside of the guitar's soundboard 13 between the braces 53. The sleeves 12 are electronically connected to an output jack 2 located elsewhere inside the instrument via a cable 5. With the two mounting pads 79 securing the upper portion of the transducer assembly 1 to the soundboard 13, the tension of the spring 80 will serve to secure the plugs 4 into the sleeves 12. This will simultaneously mount the transducer assembly 1 into the guitar's soundhole 10 and electronically couple the device to an output jack 7 for communication outside of the instrument. It is possible that the cable 81 could be embedded within the spring clip 80.

Figure 30:
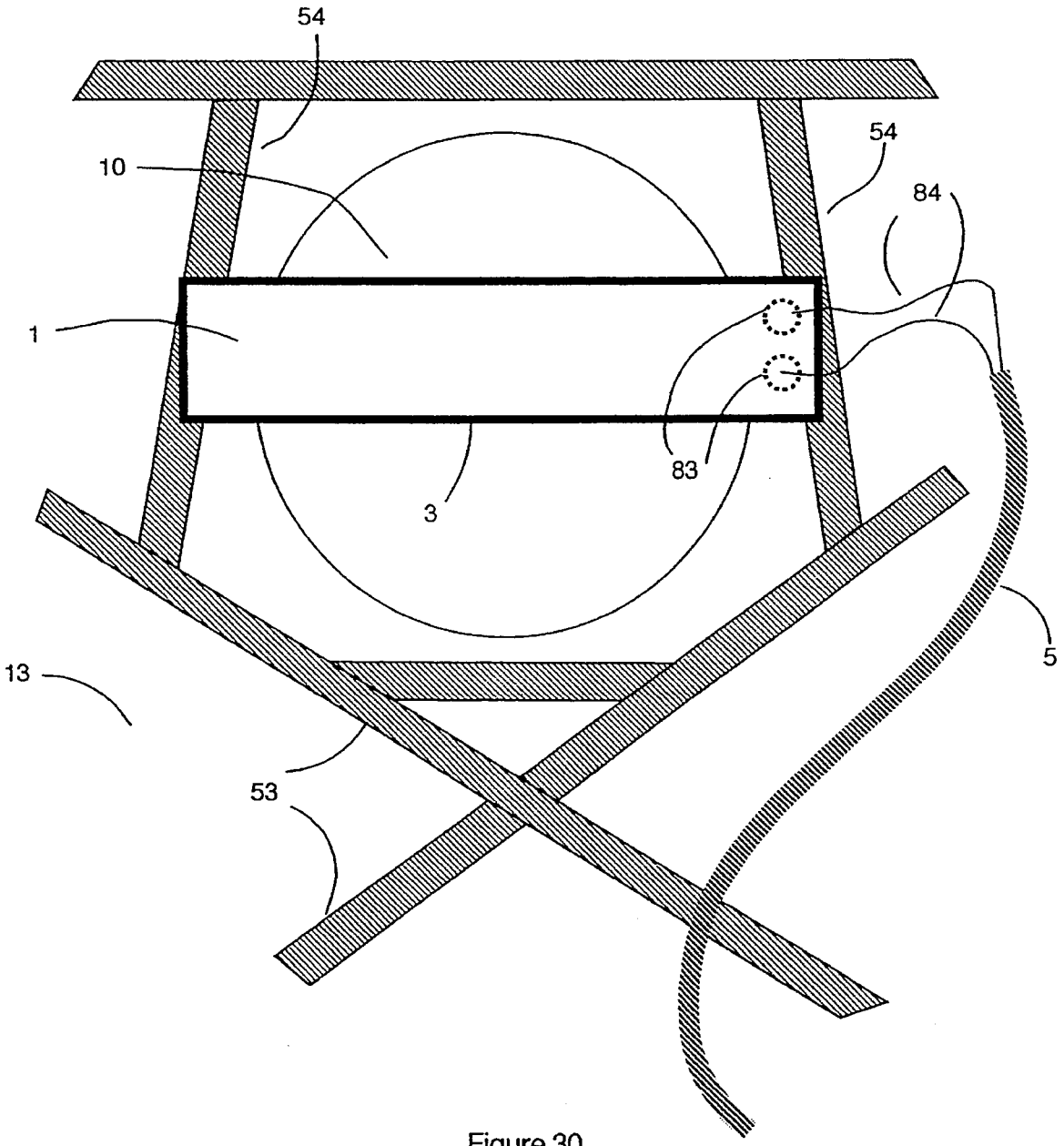
FIG. 30 is the view from inside an acoustic guitar where a transducer assembly is mounted into the soundhole which embodies electronic terminals on one end of the device which connect with terminals mounted on the underside of the guitar's soundboard near the soundhole.

FIG. 30 shows another design incorporating many prior art features. A transducer assembly 1 is mounted to guitar's soundboard 13 inside the soundhole 10. The transducer assembly 1 embodies friction electronic terminals 83 which are connected to the output signals of the transducer assembly 1 and the guitar's output jack (not shown) via the conductors 84 and cable 5.

Figure 31:
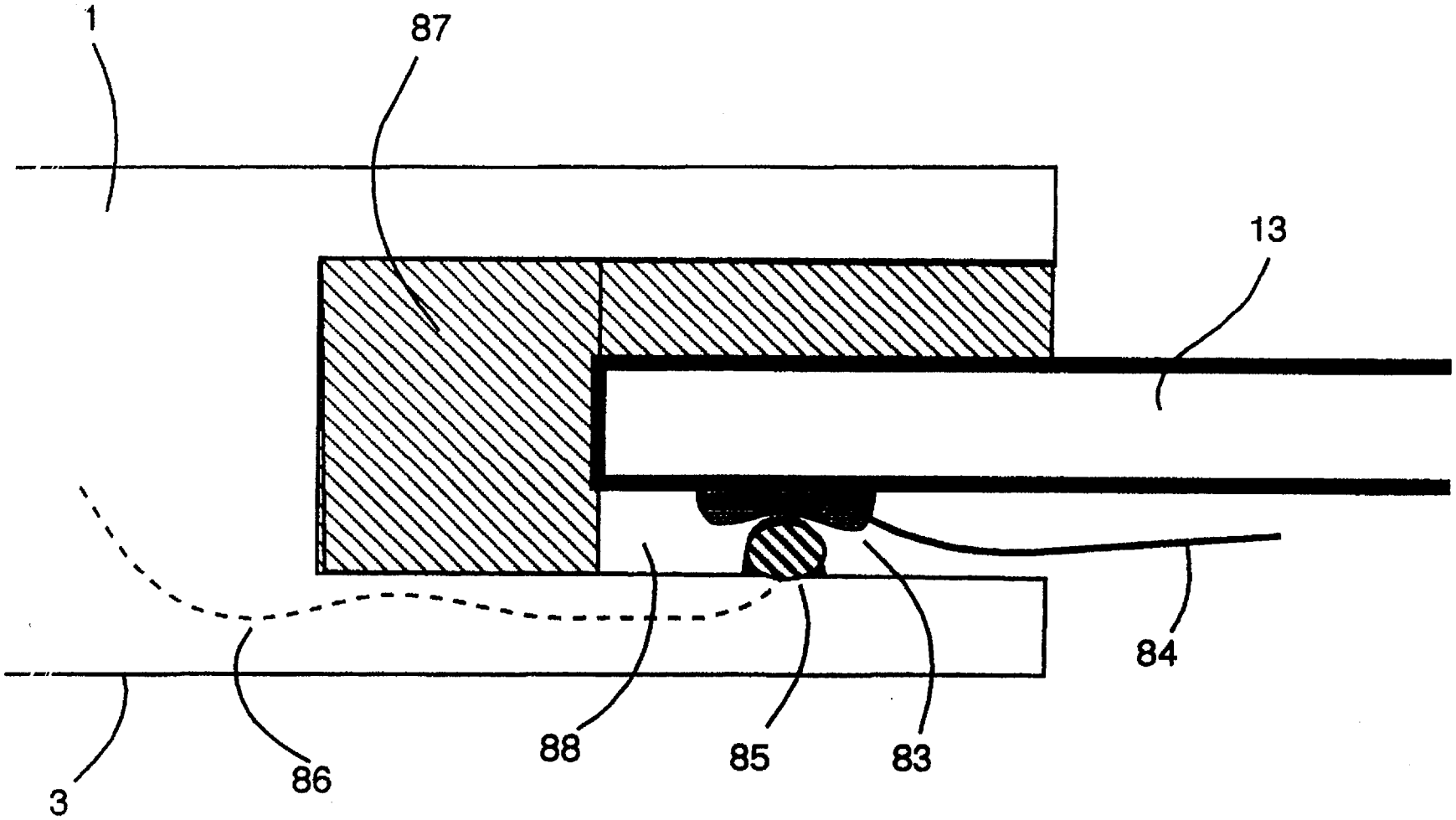
FIG. 31 is a detailed side view of the transducer assembly in FIG. 30.

FIG. 31 shows a detailed side view of FIG. 30. The output conductor 86 of the transducer assembly 1 is electronically connected to the domed terminal 85. This domed terminal 85 will mate with a recessed terminal 83 which is mounted to the underside of the soundboard 13 (this side view shows only one of each of the terminals 83 and 85). This recessed terminal 83 is electronically connected to the guitar's output jack 7 via the conductor 84 for communication outside of the instrument. The transducer assembly 1 is secured to the edge of the soundboard by foam pads 87 which are inserted into a groove 88 carved into both ends of the transducer assembly 1. The foam pads 87 have sufficient tension to support the transducer assembly 1 against the soundboard 13, and secure the terminals 83 and 85 together. At the same time, the foams pads 87 protect the transducer assembly 1 from marring or damaging any parts of the soundboard 13. On the end of the transducer assembly 1 opposite the terminals 83, additional foam pads 87 will be installed in place of the terminals 83 to provide support for the transducer assembly 1 against the underside of the soundboard 13.

Figure 32:
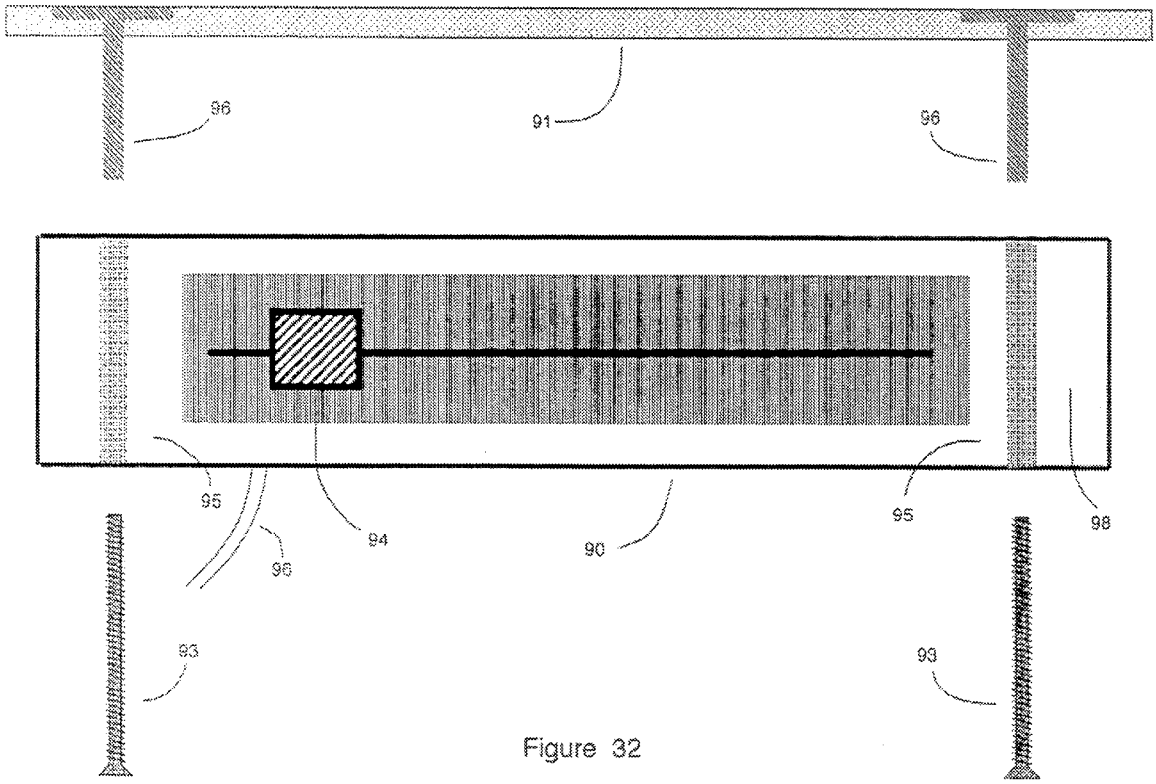
FIG. 32 provides specific information regarding how an independent electronic device which will service the transducer assemblies of this invention may be attached to a mounting pad composed of wood or similar materials via threaded inserts and machine screws.

FIG. 32 shows a mechanism for mounting an independent electronic device 90 which is electronically connected to the receptacle 2. The mechanism consists of a mounting pad 91 composed of wood or similar material into which are set two threaded inserts 96. A casing 98 of conductive material encloses the components of the independent electronic device 90. FIG. 32 shows the components as a single slide potentiometer 94, but any type of electronic component or device might be enclosed within a casing 98 for attachment to the mounting pad 91. The casing embodies two tubular channels 95 through which machines screws 93 may pass. The tubular channels 95 are larger in diameter than the threaded inserts 96. Thus, the threaded inserts 96 may slide, or telescope into the tubular channels 95, permitting the casing 98 to abut the mounting pad 91. The machine screws 93 may enter the tubular channel 95 from the direction opposite the mounting pad 91 so that the machine screws 93 may engage the threaded inserts 96 and secure the casing 98 of the independent electronic device 90 to the mounting pad.

FIG. 33 shows the installation of the mounting pad 91 and independent electronic device 90 described in FIG. 32. The mounting pad 91 to which the casing 98 is attached is glued to the flat brace 54 commonly found on the underside of the guitar's soundboard 13 near the soundhole 10. This will permit an instrumentalist to insert his/her finger through the soundhole to activate the knob of the potentiometer 94. A cable 96 emerges from the casing 98 and is electronically connected via solder joints 97 to the cable 1 which is electronically connected to the two small sleeves 12 and 19 of the receptacle 2. This will permit the signals from the transducer(s) within the transducer assembly 1 to travel to and from the independent electronic device 90.

What is claimed is:

1. A transducer mounting system for an acoustic musical instrument having a sound box, a sound board and a sound hole in the sound board, the transducer mounting system comprising:

a plurality of receptacles for mounting on the musical instrument in a first location electronically coupled to an output jack for mounting on the musical instrument in a second location, and a transducer assembly comprising a transducer that is:

(a) electronically coupled to an equal number of connectors receivable in the receptacles and (b) positionable to detect sound waves traveling though the sound hole.

2. A transducer mounting system for an acoustic musical instrument comprising:

a receptacle for mounting on the musical instrument in a first location electronically coupled to an output jack for mounting on the musical instrument in a second location, a transducer assembly comprising a transducer electronically coupled to a connector receivable in the receptacle, a plurality of receptacles for mounting on the musical instrument and an equal number of connectors receivable in the receptacles, wherein the receptacles comprise metallic sleeves arranged in a plurality of rows, and sleeves in a row are spaced approximately ten millimeters apart on center, the rows are spaced approximately five millimeters apart on center, and adjacent rows of receptacles are offset to provide separation by positioning each receptacle in a particular row approximately mid-way between the nearest two receptacles in an adjacent row.

3. The transducer mounting system of claim 2 wherein one of the rows of sleeves comprises three sleeves, each having an outside diameter of approximately 3/16" and an inside diameter of approximately 0.159", another of the two rows of sleeves comprises two sleeves having an outside diameter of approximately 1/8" and an inside diameter of approximately 0.097", and a third row of sleeves comprises three sleeves having an outside diameter of approximately 1/8" and an inside diameter of approximately 0.097".

4. The transducer mounting system of claim 2, further comprising means for attaching the receptacle to the instrument.

5. The transducer mounting system of claim 4, wherein the means for attaching comprises at least one screw.

6. The transducer mounting system of claim 4, wherein the means for attaching comprises adhesive.

7. A transducer mounting system for an acoustic musical instrument comprising:

a receptacle for mounting on the musical instrument in a first location electronically coupled to an output jack for mounting on the musical instrument in a second location, a transducer assembly comprising a transducer electronically coupled to a connector receivable in the receptacle, and a control mounted on the transducer assembly and electronically coupled to the transducer.

8. A transducer mounting system for an acoustic musical instrument having a sound box, a sound board and a sound hole in the sound board, the transducer mounting system comprising:

a receptacle for mounting on the musical instrument in a first location electronically coupled to an output jack for mounting on the musical instrument in a second location, at least one screw for attaching the transducer assembly to the receptacle, and a transducer assembly comprising a transducer that is:

(a) electronically coupled to a connector receivable in the receptacle and (b) positionable to detect sound waves traveling though the sound hole.

9. A transducer mounting system for an acoustic musical instrument comprising:

a receptacle for mounting on the musical instrument in a first location electronically coupled to an output jack for mounting on the musical instrument in a second location, and a transducer assembly comprising a microphone mounted onto a foam pad and electronically coupled to a connector receivable in the receptacle.

10. A transducer mounting system for an acoustic musical instrument having a sound box, a sound board and a sound hole in the sound board, the transducer mounting system comprising:

a receptacle for mounting on the musical instrument in a first location electronically coupled to an output jack for mounting on the musical instrument in a second location, and a transducer assembly comprising a transducer that is:

(a) electronically coupled to a connector receivable in the receptacle and (b) positionable to detect sound waves traveling though the sound hole, wherein the tranducer assembly comprises a first casing within which the transducer is mounted and a second casing on which the connector is mounted.

11. A receptacle for a transducer assembly for a guitar having a sound board having an underside, the receptacle comprising a casing for mounting on the underside of the sound board and terminals recessed within the casing that are electronically coupled to an output jack for location elsewhere on the guitar.

12. The receptacle of claim 11, further comprising a mounting pad consisting of wood for gluing to the underside of the soundboard, and threaded inserts embedded within the mounting pad for receiving screws to secure the casing to the mounting pad.

13. The receptacle of claim 11, further comprising a mounting pad consisting of wood and screws embedded in the mounting pad for securing the casing to the mounting pad with nuts.

14. The receptacle of claim 11 wherein the casing is embedded within a structural brace attached to the soundboard of a guitar.

15. The receptacle of claim 11, further comprising controls electronically coupled to the terminals for the purpose of controlling the transducer assembly.

16. The receptacle of claim 11, further comprising electronic components coupled to the terminals for electronic coupling to the transducer assembly.

17. The receptacle of claim 12, further comprising electronic components mounted on the pad and coupled to the terminals for electronic coupling to the transducer assembly.

* * * * *